US006695689B2

(12) United States Patent
Abe

(10) Patent No.: US 6,695,689 B2
(45) Date of Patent: Feb. 24, 2004

(54) DETECTOR UNIT FOR COIN BLOCKAGE IN A COIN DISPENSER

(75) Inventor: Hiroshi Abe, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 215 days.

(21) Appl. No.: 10/021,722

(22) Filed: Dec. 12, 2001

(65) Prior Publication Data

US 2002/0072319 A1 Jun. 13, 2002

(30) Foreign Application Priority Data

Dec. 13, 2000 (JP) ..... 2000-378582
Jan. 17, 2001 (JP) ..... 2001-009498
Feb. 22, 2001 (JP) ..... 2001-047225

(51) Int. Cl.[7] ..... G07D 1/00
(52) U.S. Cl. ..... 453/33; 453/49; 194/200
(58) Field of Search ..... 453/33, 16, 49, 453/50, 24, 25; 194/200, 344, 345, 346; 198/464.4; 193/DIG. 1

(56) References Cited

U.S. PATENT DOCUMENTS 821,624 A * 2/1906 Weinreb et al. ..... 137/512.3
3,942,544 A * 3/1976 Breitenstein et al. ..... 453/17
4,589,433 A 5/1986 Abe ..... 133/5 R
5,647,469 A * 7/1997 Yamagishi et al. ..... 194/200
5,810,655 A 9/1998 Suzukawa et al. ..... 453/50
5,924,919 A 7/1999 Hirano ..... 453/57
6,059,651 A 5/2000 Abe et al. ..... 453/50
6,086,472 A * 7/2000 Furukawa ..... 453/3
6,261,170 B1 7/2001 Bell et al. ..... 453/57

FOREIGN PATENT DOCUMENTS

WO WO-90/02389 A1 * 3/1990 ..... G07D/9/04

* cited by examiner

*Primary Examiner*—Donald P. Walsh
*Assistant Examiner*—Mark Beauchaine

(57) ABSTRACT

A coin dispensing mechanism for dispensing coins stored in bulk in a storage hopper through a coin passage to an exit aperture includes a selector member for individually selecting coins from the storage hopper and delivering the coins to the coin passage. The coin passage further includes a coin passageway having a lower surface for supporting the translation of the coins to the exit aperture and an upper surface having a configuration capable of receiving coins moved off of the lower surface. A detector unit is operatively mounted relative to the upper surface to detect a coin. In normal operation, the dispensed coins will travel across the lower surface and be ejected. If there is a coin blockage, one or more coins will be moved adjacent to the upper surface and the detector unit will detect the position of the coin and indicate a blockage in the coin dispensing mechanism.

16 Claims, 19 Drawing Sheets

PRIOR ART

DETECTOR UNIT FOR COIN BLOCKAGE IN A COIN DISPENSER

BACKGROUND OF THE INVENTION

1. Field of the Invention

The present invention is directed to coin dispensers for dispensing stored coins, and more particularly to an improved detector unit assembly for detecting the blockage of coins being dispensed.

2. Description of the Prior Art

Coin dispensing apparatus that can be mounted in various types of machines to dispense change and/or winnings in a gaming machine are well known. An example of a hopper type coin dispensing apparatus is seen U.S. Pat. No. 4,589,433. A storage hopper can store coins in bulk, and a rotary disk member can agitate the stored coins and selectively engage individual coins and rotate them to a coin dispensing passageway. Such coin dispensers can be installed within a gaming machine 100 disclosed in FIG. 28, having a coin hopper 101, with a disk charge exit 102. Referring to FIG. 29, a support frame 111 extends vertically upward from a base 110. The base 110 can be mounted within the gaming machine. A hopper support base 112 is fixed to the frame 111, at an angle of 60° to the horizontal. A motor 113 can be attached to the rear surface of the hopper base 112. A rotation disk 114, which can be driven by the motor 113 through a reduction gear, is mounted for rotation on a surface of the hopper base 112. The rotating disk includes a coin supporting surface 116, which extends annularly about the rim of the rotating disk 114. A ledge or tier 115 is provided on the rotating disk 114, while pins 117 are spaced at predetermined positions or intervals to be able to engage and separate individual coins on the coin load plane 116 for further support on the tier 115.

A cylindrical hopper ring 118 is fixed on the hopper base 112, and in turn, supports a coin bowl 119 that can be fixed to the hopper ring 118. The coin bowl has a coin opening 120 on an upper side wall. A coin separating receiving knife edge 121 is fixed on the hopper base 112 and is located near the tier 115.

A coin counter 130 includes a shaft 131 fixed to the hopper base 112 and a lever 132 which pivots around the shaft 131. A count roller 133 is provided at the end of the lever 132, while a count sensor will sense the movement of the lever 132 to provide a count of the coins being dispensed. A guide plate 134 can cover the base of the knife member 121. A spring (not shown) can bias the lever 132 in a counter-clockwise direction. A stopper that is located on the hopper base 112 can be utilized to maintain the lever in a desired position. The coin passageway 135 includes the hopper base 112, the guide plate 134, and the upper surface of the knife member 121 to thereby provide a coin passageway 135, with a coin exit 136 at the end of the passageway.

When a customer activates the gaming machine shown in FIG. 28 by inserting a coin within the entrance slot 103, game play is initiated. The coin can be dispensed into the coin bowl 119 through a duct (not disclosed). If the customer wins, the game machine, through a control device, such as a microprocessor based computer system, can output a signal to discharge a fixed number of coins. Upon such an occasion, the motor 113 of the coin hopper will rotate it, so that the rotating disk 114 (shown in FIG. 29) will rotate in a counter-clockwise direction. The coins will be agitated in the coin bowl 119 and individual coins can engage the pins 117. The coins will be supported by the tier 115 as they are transported upward by the rotating disk 114. When the coins come into contact with the knife member 121, the coin will be released or redirected to the rotating disk 114 into the coin passageway 135. The pin 117 will push the coin into the coin passageway 135. A roller will contact the coin as it enters the coin passageway, and will in turn, move the lever 130 in a clockwise direction to provide an activation of a count sensor unit. The count sensor unit will output a signal every time a coin comes into contact with a roller 133. When the count sensor becomes a predetermined number, the motor 113 will stop its rotation and thereby stop the discharge of the coins.

If a person attempts to insert a hand, or other object into the coin exit 102 during the discharging of the coins, the coin exit 136 can be blocked and the motor 113 will stop automatically, resulting either from a detection of a change in the electric current, from the resistance, or, for example, if the coin counter 130 does not output a signal. An unscrupulous person can contend that they had won the predetermined number of coins, but that the machine jammed and that they were cheated out of the dispensing of the coins.

Since there is a large number of coin dispensing hoppers already installed in gaming machines, there is a desire to not only address this problem in a relatively efficient and inexpensive manner, but also to provide a device that could be retrofitted on existing coin dispensing apparatus.

SUMMARY OF THE INVENTION

The present invention provides an improved coin dispensing mechanism and coin detecting unit which can efficiently determine a blockage or obstruction of coins being dispensed from the coin dispensing machine.

A coin passageway can have an upper undulating or irregular configuration to provide one or more compartments, or elevations, along the coin passageway to enable a coin to be moved apart from the support surface of the passageway, when a preceding coin is stopped in the passageway. A detector unit can be mounted adjacent or within, for example, a first compartment, or expansion of the coin passageway to operatively determine the location of a coin moved apart from the support surface and into the first compartment, to thereby generate a detection signal, indicating a blockage of the coin passageway. A deflector unit can be activated to deflect succeeding coins from being introduced into the passageway and to cause them to be returned to the storage hopper, when a blockage of the coin passageway occurs. Additionally, a second compartment, or elevation, in the passageway can receive a second succeeding coin that is moved apart from the support surface.

A counter unit is positioned between the detector unit and the deflector unit to provide an accurate count of coins even during a blockage of the coin passageway.

Various configurations of the coin passageway can be provided, along with various configurations of the detector member that can operatively detect a location of a coin forced upward into the first compartment above the support surface of the coin passageway.

BRIEF DESCRIPTION OF THE DRAWINGS

The exact nature of the present invention will be readily apparent from consideration of the following detailed description in conjunction with the accompanying drawings wherein.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein to specifically provide a detector unit for determining coin blockage in a coin dispenser that can be incorporated into a improved coin dispenser or retrofitted on existing coin dispensing apparatus.

A first embodiment of the present invention is disclosed in FIGS. 1–5, elements that are common in each of the embodiments and the prior art will be, where possible provided with the same reference number. The terminology "coins" as is understood in this industry can include other disks, medallions, tokens and other forms of dispensable items that can be used in arcades, gaming machines, bus tokens, etc. Accordingly, the terminology "coin" should not be considered to be limiting to monetary currency devices.

Figure 1:
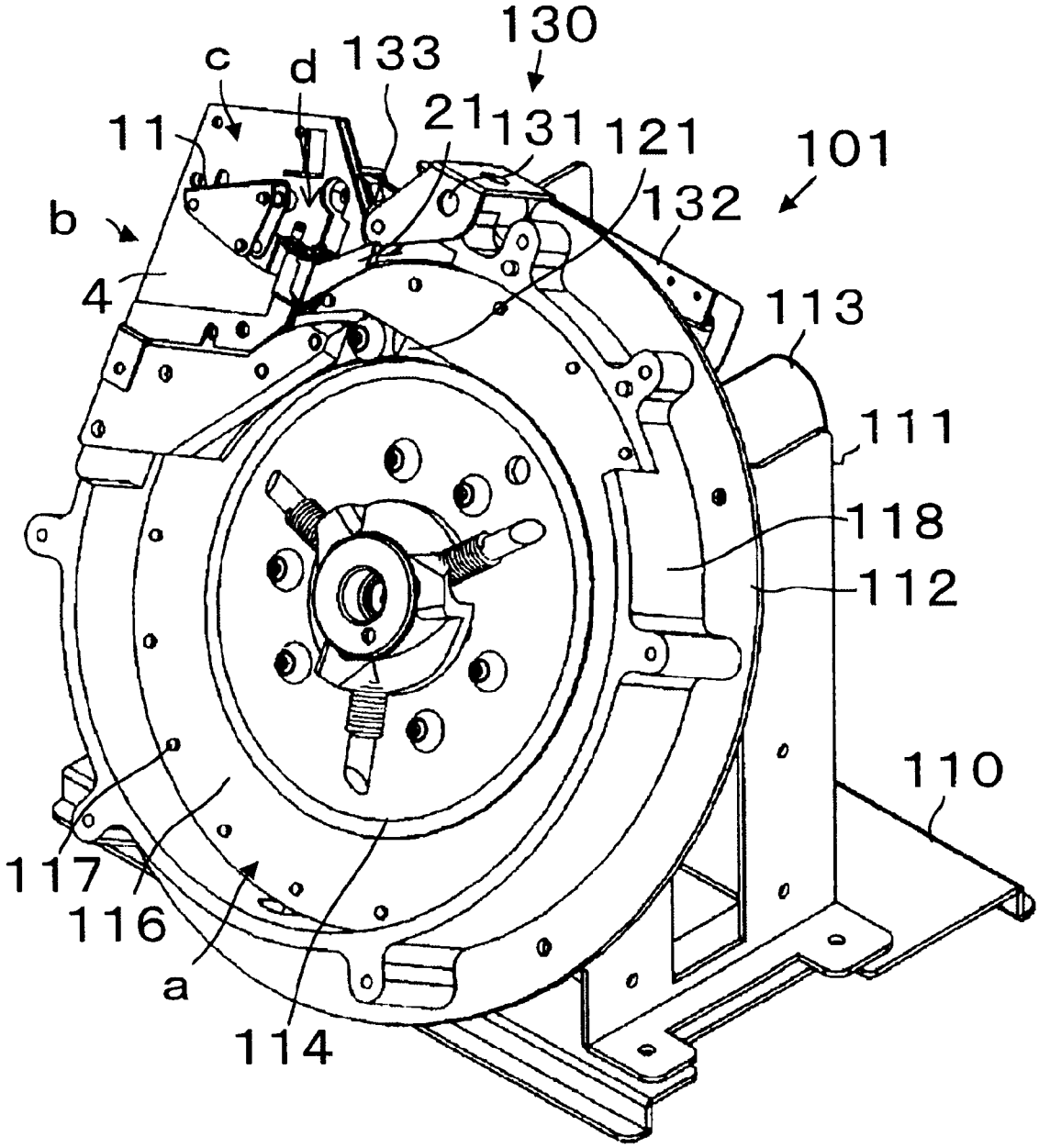
FIG. 1 is an elevated perspective view of a prior art coin dispensing mechanism.
Figure 2:
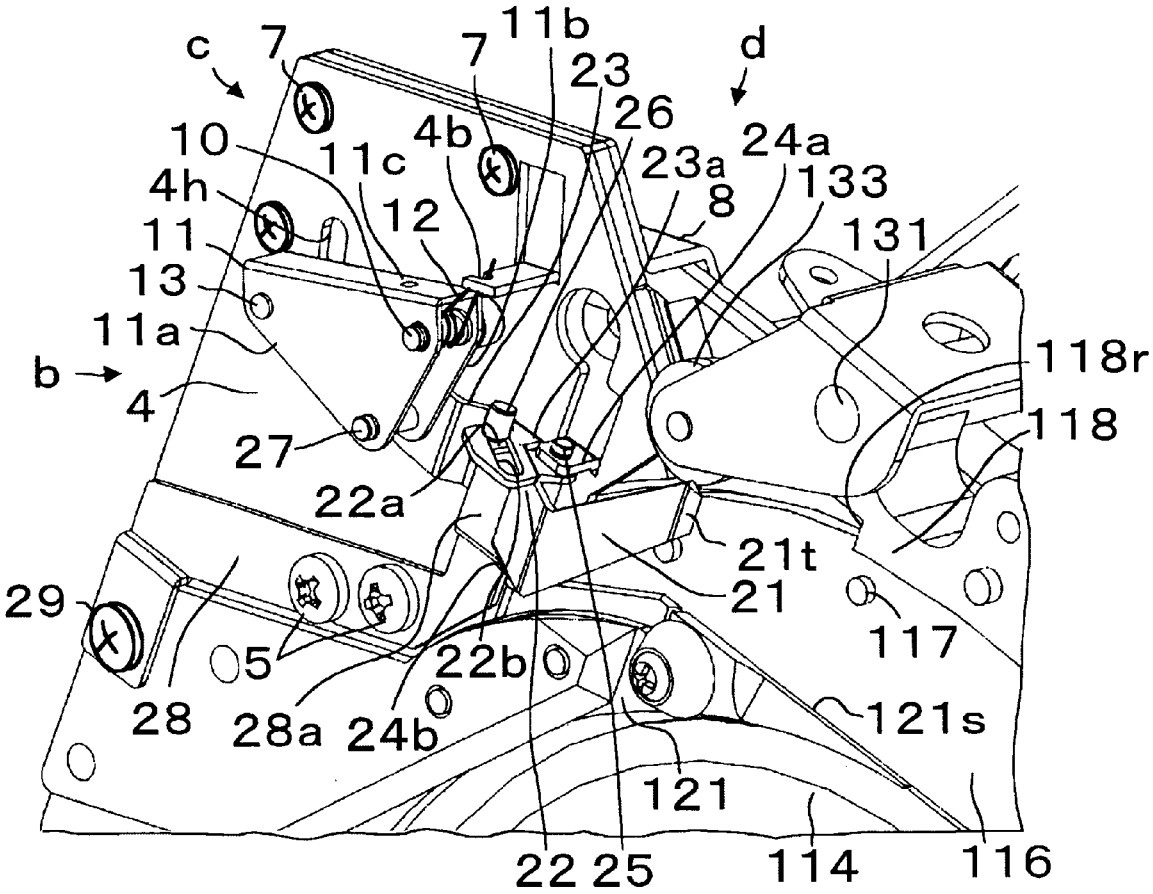
FIG. 2 is a partial perspective view of the first embodiment of a coin detecting unit and passageway.
Figure 3:
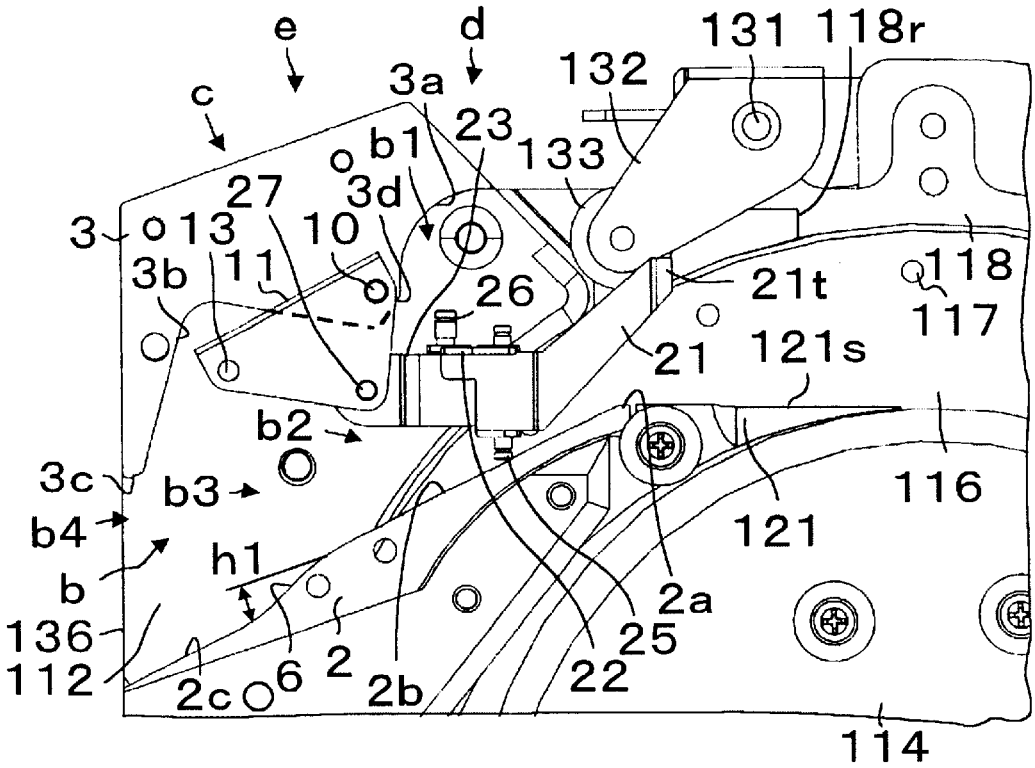
FIG. 3 is a partial plan view with the cover removed of the first embodiment.

Referring to FIG. 1 the coin pick up device or selector that rotates within a hopper or storage bowl, not shown, includes the rotating disk 114 and the spaced pins 117. As described the coins are individually selected and progressively moved upward on the inclined disk 114 as spaced by the pins 117 to contact the knife member 121 shown for example in FIG. 3. A coin passage B includes the hopper base 112, the lower guide 2, the upper guide 3 and the cover 4 as shown in FIG. 2. The inclination of the coin passage B is slanted slightly downwards to the left as shown in FIG. 3 and the lower guide 2 is slightly thicker than a coin to provide a rolling support surface. The lower guide 2 as shown in FIG. 2 is located near the end of the upper surface 121*s* of the knife member 121 and is fixed on the reversed side of the cover 4 by a screw 5. The lower guide 2 is shaped in a elongated narrow configuration comprising a first guide 2*a*, a second guide 2*b* and a detecting guide 2*c*. The first guide 2*a* is level with and continues from the upper surface 121*s* of knife member 121. The guide 2*b* slants downwards to the left from the first guide 2*a* and merges into the detecting guide 2*c*. The guides collectively provide a lower support surface for translating the coins through a coin passageway. The elevation gap 6 between guide 2*b* and detecting guide 2*c* has a purpose of assisting a second succeeding coin that is traveling on the guide 2*b* when contacting a preceding coin that is held stationery by a blockage or obstruction on the guide 2*c* to there by permit the second coin to be forced upward off the support surface of the guide 2*b*. Thus, the second coin can be elevated into a extension or compartment above the normal travel of the coins in the coin passage way.

The upper part of the coin passage way is defined by the configuration of an upper guide 3 that is fixed on the reverse of a cover 4 by a screw 7 which extends through the cover 4 to the rear support 8. The upper guide 3 has a sinusoidal configuration or roughly a "L" shape in the horizontal direction, and it is of the same thickness of the lower guide 2. The upper guide 3 with its undulating upper surface is of such a configuration to complement the outer configuration of the coins. It should be noted that the detecting guide 2*c* is longer than the diameter of the coin and the upper guide 3 includes a second guide 3*a* above the guide 2*b*, a concave portion 3*d*, a depression or concave portion 3*b*, and a third guide 3*c*. The depression or concave portions 3*a* and 3*b* define compartments that are adapted to receive and support the location of coins when there has been an obstruction in the coin passage way.

The cover 4, shaped in an upside down "U" configuration, can be affixed by a screw 7 to a hopper base 112. Lower body of the cover 4 can be affixed to the hopper base by a guide board 28 which is screwed or fastened by the screw 29. As can be determined, the thickness of the coin passage is defined by the cover 4 in the hopper 112 that can be subjectedly designed to accommodate a specific configuration or denomination of coin. The coin passage way D includes a first passage b1, a second passage b2, a third passage b3, and a fourth passage b4. Passage b1 is defined by the guide 2*b* and second guide 3*a*. The second passage b2 is defined by the guide 2*b* in the concave configuration 3*d*. The third passage b3 is defined by the guide 2*b* and the depression 3*b*. The fourth passage b4 is defined by the detecting guide 2*c* and the third guide 3*c*.

Figure 4:
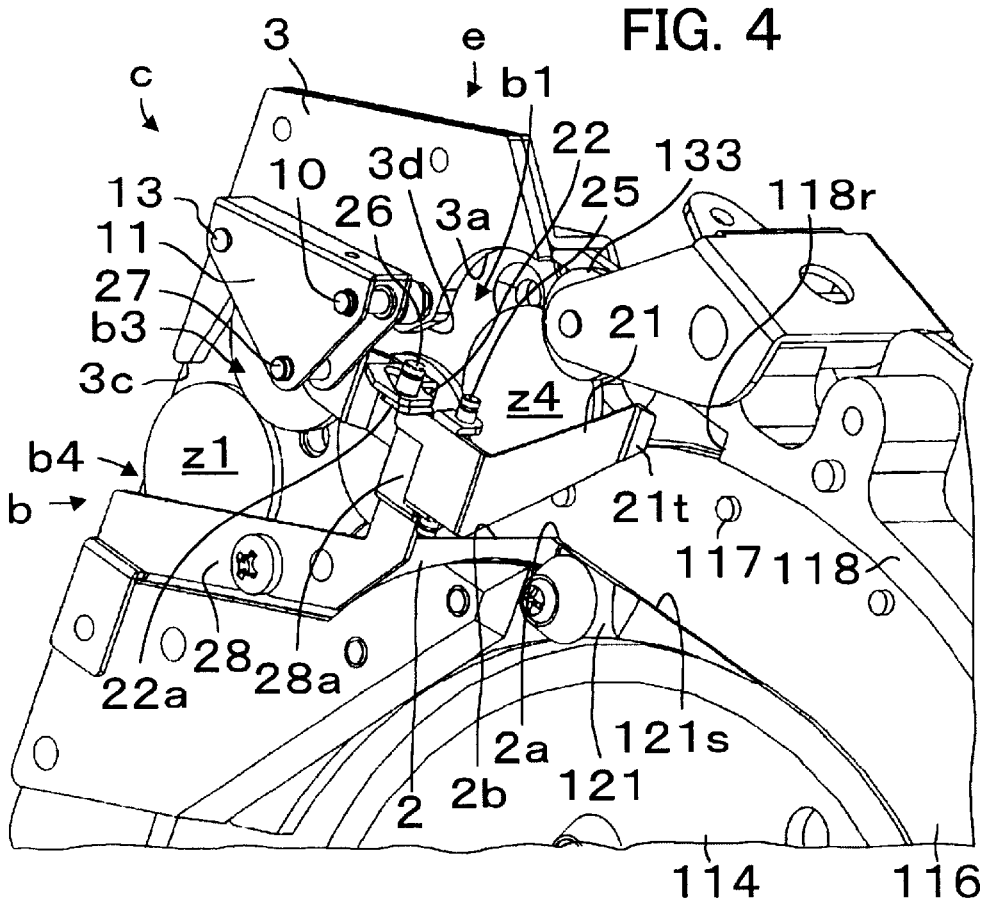
FIG. 4 is a partial perspective view indicating a coin blockage condition of the first embodiment.

As can be seen in FIG. 3, the coin exit 136 is at the end of the fourth passage b4. The height of the first passage b1 as shown in FIG. 4 is approximately 1½ times the coin diameter. The coin area e shown in FIG. 4, is the first passage b1. The height of the second passage is slightly higher than the diameter of the coin while the height of the third passage b3 is again approximately 1½ times the size of the coin diameter. Finally the height of the fourth passage b4 is slightly higher than the diameter of a coin.

A coin detector or sensor C operates as followings. An elongated hole 4*h* is provided under cover 4 adjacent to depression 3*b*. This holes extends to the opposite side of the gap 6 between the guide support surface 2*b* and 2*c*. A shaft 10 is fixed to extend traversely above the coin passage way. A triangular detecting lever unit 11 has a channel like shape and includes a pair of side boards 11*a* and 11*b* and a connection board 11*c*. Thus, the detecting lever 11 is triangular like in shape is pivoted on the fixed shaft 10 which extends between the side boards 11*a* and 11*b*. A spring 12 can bias the detecting lever 11 to move in a counter-clockwise direction, the spring can be mounted or hooked to the projection 4*b* of the cover 4 and to the connection board 11*c*. The end of a first shaft 13 can be fixed to side board 11*a* and 11*b* and projected to the side of the hopper base 112. Thus the shaft 13 forms a detector 14 for contacting an elevated coin that can extend into the first compartment or concave depression when there is a coin blockage, see FIG. 5. The detector 14 is projected into coin passage B through the elongated hole 4*h* and is located near the concave depression 3*b* of the third passage 3*b*. The lower end of the elongated hole 4*h* is a stopper which engages with the defector 14 and holds it above the normal passage way of unobstructed coins. Thus, when defector 14 is biased by the spring 12 to the stopper it will not have contact with a coin which will normally pass through the third passage b3. A roller can be attached to the shaft 13 which forms part of the defector 14 in an alternative embodiment.

Figure 30:
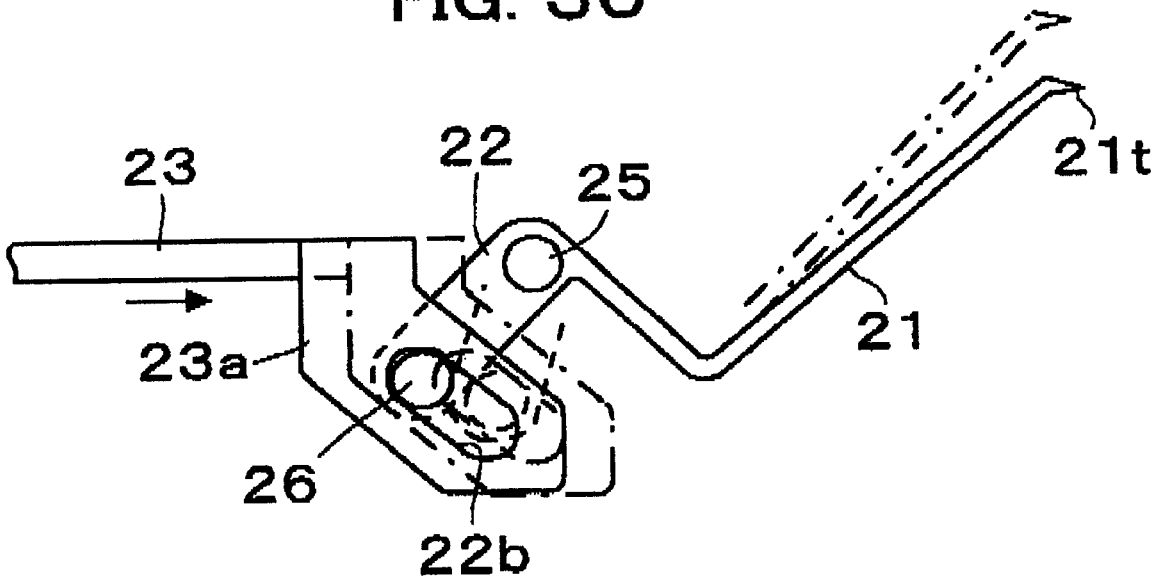
FIG. 30 is a schematic plan view of a deflector unit.

Referring to FIG. 2, a diverting mechanism or deflecting unit D can be utilized. The diverting device D includes a scraper member 21 which is a diverter, a lever 22 and a connecting rod 23 (see FIG. 30). The scraper 21 is mounted on a shaft 25 which is fixed to brackets 24*a* and 24*b* of the cover 4. The scraper 21 can move relative to the fixed shaft 25. The fixed shaft 25 is located above the guide 2*b* as shown in FIG. 3. The scraper 21 has a projecting tip 21*t* that is shaped like a tongue and can be moved to the depression 118*r* of the hopper ring 118. This depression 118*r* is located above the middle of the top surface of the knife member 121*s*. Lever 22 which is connected with the scraper member 21 extends opposite to the fixed shaft 25 and is extended opposite the rotating disk 114. An inclined elongated hole 22*b* is perforated through connecting rod 23 at the end 23*a*. A pin 26 is fixed to the level piece 22*a* of lever 22 to pass through the elongated hole 22*b* to thereby slide along a hole 22*b*. The other end of connecting rod 23 pivots at the fixed shaft 27 on the side board 11*a* and 11*b* of the detecting lever 11. The middle of connecting rod 23 is located between the upper portion 28*a* of the guide board 28 and the cover 4 to permit a sliding movement, see FIG. 2. This particular configuration or structure helps minimize any breakage of a connecting rod 23 due to a compressive force. In normal operation, detector 14 is engaged at the lower end of the elongated hole 4*h*, the scraper 21 is moved in a clockwise direction through shaft 27, connecting rod 23, pin 26 and the slanting elongated hole 22*b* shown in FIG. 2. The end 21*t* of the scraper member 21 is located above the plane 116 and is at a predetermined distance to the plane see both FIG. 2 and FIG. 3. As a result, a coin that is resting on the slanted plane 116 will not normally contact the scraper 21.

In a normal operation, the detector 14 is engaged at the lower end of the elongated hole 4*h* and the end 21*t* of the scraper 21 is linked to the detector 14 for movement in a semi-circle in the clockwise direction. As a result, the tongue end 21*t* is also located at a predetermined distance away from the rotating disk 114 carrying coins to be dispense through the coin passage way. Accordingly, during the rotation of the rotating disk 114 a coin will move from the plane 116 to be separated to the top surface 121*s* of the knife member 121. The coin will be urged to the left of this top surface by the movement of the pin 117, in this manner the coin will pass under the scraper 21. When the coin is moved from the top surface 121*s* to the first guide 2*a*, as a result of being pushed by the pin 117, the coin will encounter and push upward the count roller 133 shown in FIG. 2. As a result, this count lever 132 is moved in a clockwise direction and a count signal is outputted by the detector in a conventional manner not illustrated. The coin will then precede forward to roll on the guide 2*b* as it passes through the respective passages b1, b2 and b3 and is discharge to the coin exit 136.

Figure 5:
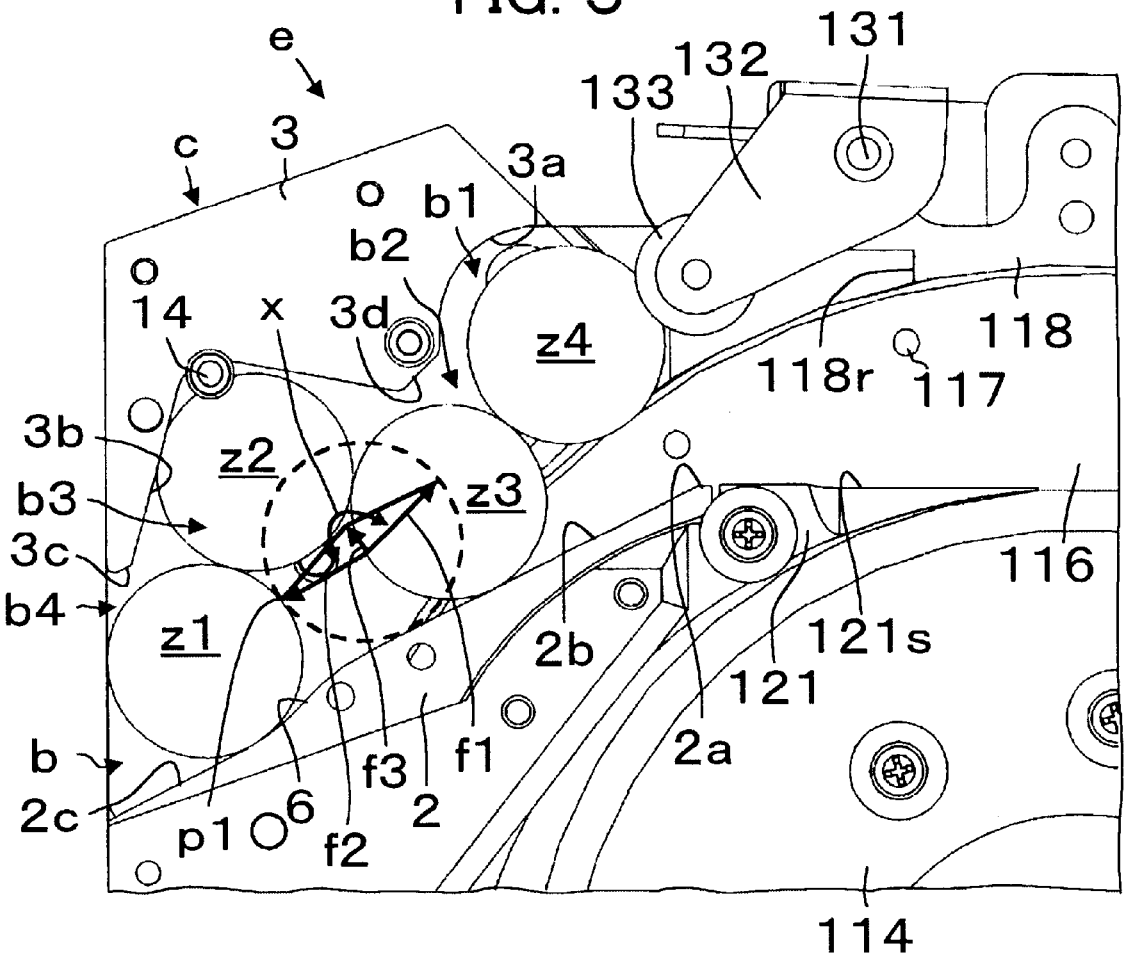
FIG. 5 is a partial plan view illustrating the coins blocked in the first embodiment.

If a person or an object however, obstructs the passage of such a coin, see for example FIGS. 4 and 5, a first coin z1 is held between the third passage b3 and fourth passage b4. The second succeeding coin z2 will contact the first coin and will be held in the third passage b3 as shown by the dotted line in FIG. 5. A third coin z3 is kept between the second passage b2 and first passage b1 because it is contacted and has been stopped by the second coin z2, a fourth coin z4 which has been pushed by the pin 117 will move from the top surface 121*s* of the knife member 112 towards the first guide support surface 2*a*. As a result of the forces generated, the third coin z3 is urged by the fourth coin z4 forward toward the coin exit 136 in the third passage b3, the third coin z3 as shown in FIG. 5 is limited in its ability to be elevated off the guide support surface by the downward projection 3*d* and will exert a force vector on the second coin z2 causing it to climb upward and contact detector 14 and be elevated into the first compartment or depression 3*b*. Thus, the coin does not pile up in the coin passage b but is pushed by the vector f2 of the third coin z3. The direction of the vector f2 is parallel to the guide 2*b* since there is a gap or difference in level between the surface 2*c* and 2*b* the second coin z2 will be compressed between the opposite at force f1 of held first coin z1 and the pushing force f2 of the third coin z3. The angle between the opposing forces f1 and f2 is an obtuse angle and coins have a curved surface therefore coin z2 upon receiving a corresponding vector force f3 will be directed into the depression 3*b*. The second coin z2 will be guided by the wall of the depression 3*b* and the detector 14 and will ultimately arrive in the first compartment as shown by the solid line of the coin configuration in FIG. 5. The detector 14 is pushed upward by the second coin z2 and is thereby moved in the clockwise direction. As a result, the connecting rod 23 moves to the left direction of the figure. This movement causes the pin 26 to be pushed by the end 23*a* and the lever 22 therefore moves in a counter clockwise direction as shown in FIG. 2. As a result, the scraper member 21 rotates in the same direction and end tongue 21*t* of the scraper member 21 moves to the depression 118*r* and is thereby operative placed a divert position adjacent to the plane 116 of the rotating disk 114 as shown in FIG. 4. The fourth coin z4 is pushed by the pin 117 after the second coin z2 is moved the depression 3*b*. As a result, the fourth coin z4 is moved to the second compartment or arc portion 3*a* and is held in that position by the third coin z3 shown in FIG. 5.

As shown in FIG. 5, the fourth coin further pushes up the count roller 133 and is held between the third z3 and the count roller 133 as we have determined from this position the count comer can correctly count the fourth coin while the pin 117 can pass beneath the coin z4. The third coin z3 can be pushed up by the pin 117 upon rotation of the rotating disk 114. The relative position of the concave portion 3*d* is sufficiently high to permit slight movement of the coin z3. As a result the rotating pin 114 is free to continue its rotation and the third coin z3 will be moved a slight amount by the pin 117 each time a pin 117 passes. The scraper member 21 is placed at a diverter position so that the coin on the plane 116 will not contact with the tongue 21*t* of the scraper member 21. The tongue of the scraper member 21 is slanted in an opposite direction of the plane 116. As a result, the top of the coin will be lifted from the plane 116 by the end of the scraper tongue 21*t* and will be returned to slide back into the coin bowl 119. Thus, the coin will fall from the top surface knife member 121*s* and will not reach the count roller 133. As a result, with the blockage of the coin exit 21 the coins are not jammed into the coin passage way and only the four coins are counted and held. Thus, a person attempting to interfere with the counting of the coins will not gain by blocking the coin passage way.

Figure 6:
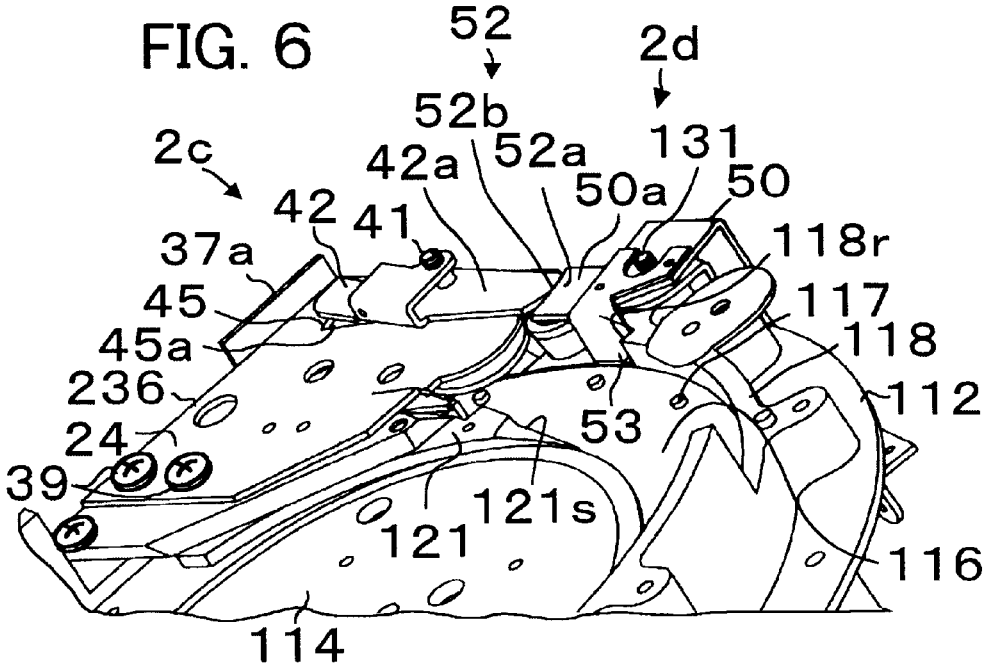
FIG. 6 is a partial perspective view of the second embodiment of the present invention.
Figure 7:
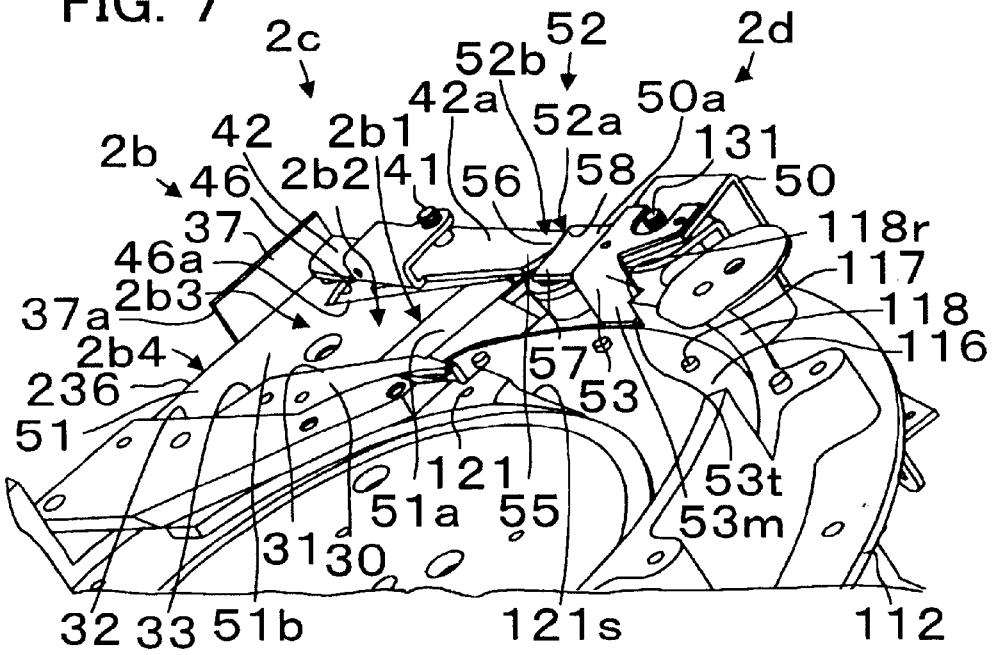
FIG. 7 is a perspective view of the second embodiment with the cover removed.
Figure 8:
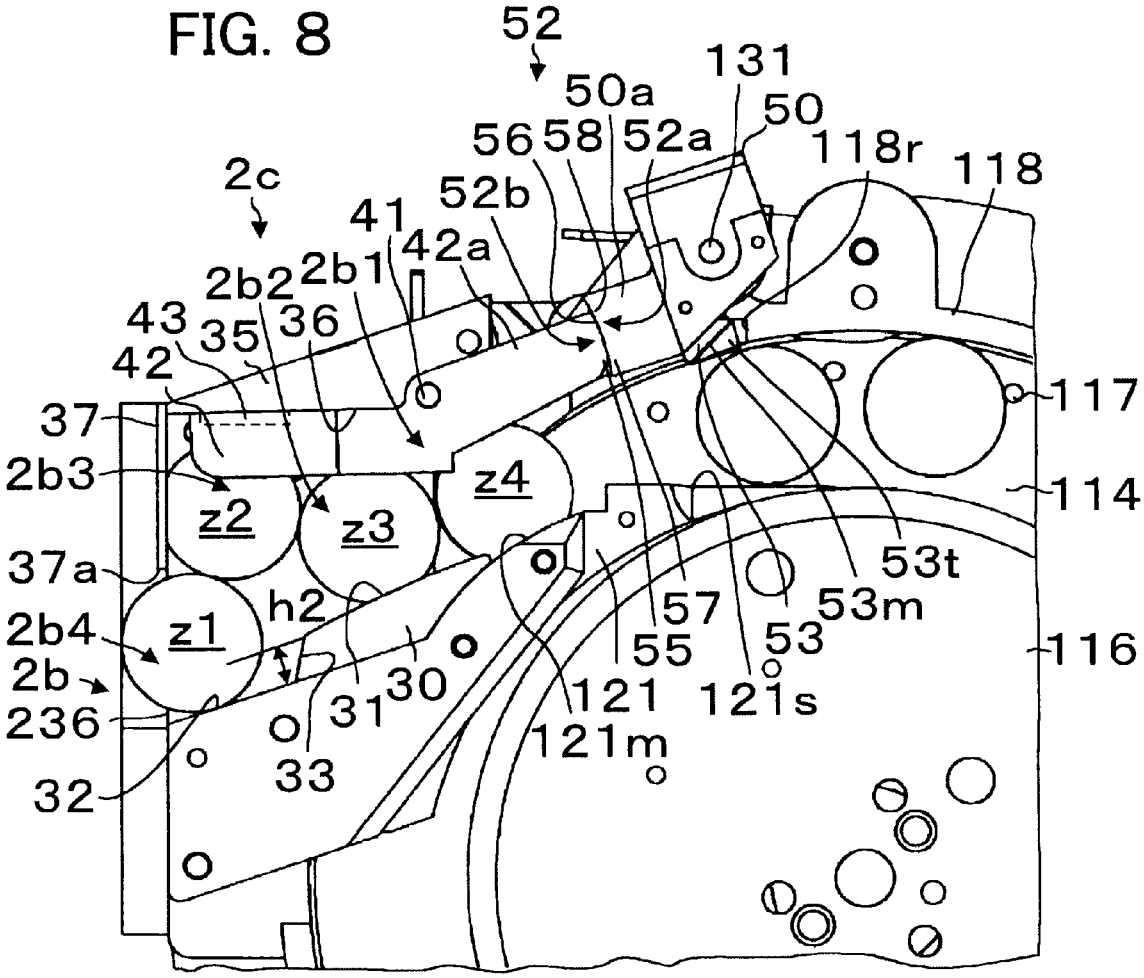
FIG. 8 is a partial plan view of the second embodiment with coin blockage.

A second embodiment of the present invention is disclosed in FIGS. 6–9. In this embodiment again a guide piece 30, as shown in FIG. 7 and FIG. 8, is mounted on the top surface of the middle of the knife member 121 and has a guide surface 31 set in the form of an arc like shape and slightly slanted to the left. An inclined straight surface forming a detecting guide 32 is located at the upper surface of the knife 121 after the guide piece 30. Thus, a gap 33 between the guide 2*b* and detecting guide 2*c* is shown by the height differential h2. Respective guide 31 and detecting guide 32 are connected by a slanted surface. The upper guide 35 is right triangular like in configuration and is fixed to the hopper base 112. A fourth guide 36 extends in a straight line in a horizontal configuration and is positioned at the lower surface of the upper guide 35. The coin exit 236 is defined between the board 37 which is fixed to the hopper base 112.

Guide 30, knife member 121, upper guide 35 are fixed to a spacer 51 which is located above the pin 117 on the rotating disk 114. The edge of the spacer 51 is slanted at guide plane 51*a* so it is not in contact with plane 116. The knife member 121 and the upper guide 35 is fixed by a fastener such as a screw 39 which can be attached to the cover 24 shown in FIG. 6. Coin passage 2*b* is defined by the guide 31, detecting guide 32, fourth guide 35, spacer 51, cover 24 and the board 37. The thickness of the coin passage 2*b* similar to that of the first embodiment. Board 37 covers the end of the coin passage 2*b*. The first passage 2*b*1 is defined by the guide 31 and fourth guide 36. The second passage 2*b*2 is defined by guide 31 and fourth guide 36. The third passage 2*b*3 is defined by guide 31, fourth guide 36 and the board 37. The fourth passage 2*b*4 is defined by lower edge 37*a* of the board and detecting guide 32.

The detecting unit 2*c* includes a detecting lever 42 that pivots around a fixed shaft 41 extending from the hopper base 112. Detecting board 43 is at the top of the detecting lever 42 and bends to the side of the hopper base 112. The detecting board 43 forms one component of the detector unit 2*c*. Opening 45 is formed at the cover 24. Opening 45 is opposite the hopper base adjacent the opening 45 as shown in FIG. 6. Detecting board 43 at the top of the detecting lever 42 is inserted between the openings 45 and 46. As a result, the detecting board 43 is located at the third passage 2*b*3. Detecting lever 42 which moves in a counter clockwise direction as result of a bias of a spring, not shown, is held at a first position because the detecting board 43 will contact the lower edges of the openings 45 and 46. This first position is out of the path of the normal dispensing of coins.

A diverting device 2*d* shown in FIG. 7 includes a lever member 50 that is pivoted around a fixed shaft 131. Lever 50 is moved in a clockwise direction by a spring (not illustrated). A Geneva mechanism 52 includes the edge of surface 52*a* of lever 50*a* and the edge of surface 52*b* of lever 42*a*.

A scraper member 53 protrudes on the opposite side of the detecting lever 42 of lever 50. The scraper member 53 has an end protrusion or tongue 53*t* shown for example in FIG. 8 and in FIG. 7 that can move in a counter clockwise direction relative to the depression 118*r* of the hopper ring 118. Thus, the end 53*t* of the scraper member 53 is located at the depression 118*r* which in turn is located near the plane 116 of the rotating disk 114. The end 53*t* includes a slanted portion 53*m* that is capable of being locating above the plane 116.

The Geneva mechanism 52 can be explained as follows. An edge surface of 52*b* of lever 42*a* includes a projection 55. A center of an arc surface 56 is fixed to the shaft 41. The edge surface 52*a* of lever 50*a* includes a projection 57 and an arc surface 58 which is the same arc dimension of arc surface 56. The detecting lever 42 moves in a clockwise direction for only a predetermined distance. Lever 50*a* is moved in an counter clockwise direction, because projection 55 pushes projection 57. Lever 58 is moved in a counter clockwise by the detecting lever 42 which moves in the clockwise direction when projection 55 pushes projection 57. As a result, the end 53*t* of lever 53 moves to the depression 118*r*. When 53*t* moves to the predetermined position arc 56 meets arc 58. As a result of this contact, lever 42*a* is moved more than the predetermined section, so that lever 50*a* does not move.

During the operation of the second embodiment detecting lever 42 is moved in a counter clockwise direction while the detecting board 43 contacts the lower edges 45*a* and 46*a* of the opening 45 and 46. As a result, the detecting board 43 will not have contact with the coin that is being normally guided in the guide 31. Lever 50 stops its movement in the counter clockwise direction under the urging of a spring, because projection 57 is engaged by projection 55 of lever 42*a*. Scraper 53 is linked with lever 50 at a predetermined position. The end 53*t* is located outside of the depression 118*r* and away from the plane 116. Therefore, when the rotating disk 114 rotates a coin will move from the plane 116 on the rotating disk 114 to the top surface 121*s* of knife member 121. The pin 117 will urge the coin to the left on the top surface 121*s* and during its movement will push up the count roller 133 when it is moved to the middle part 121*m*. A sensor will detect the count roller 133 as it is moved and outputs a detecting signal. The coin will roll to the middle 121*m* and onward to the first passage 2*b*1, second passage 2*b*2 and third passage 2*b*3. The coin will roll to the gap 33 and detecting guide 32 and will be discharged to the coin exit 236.

Figure 9:
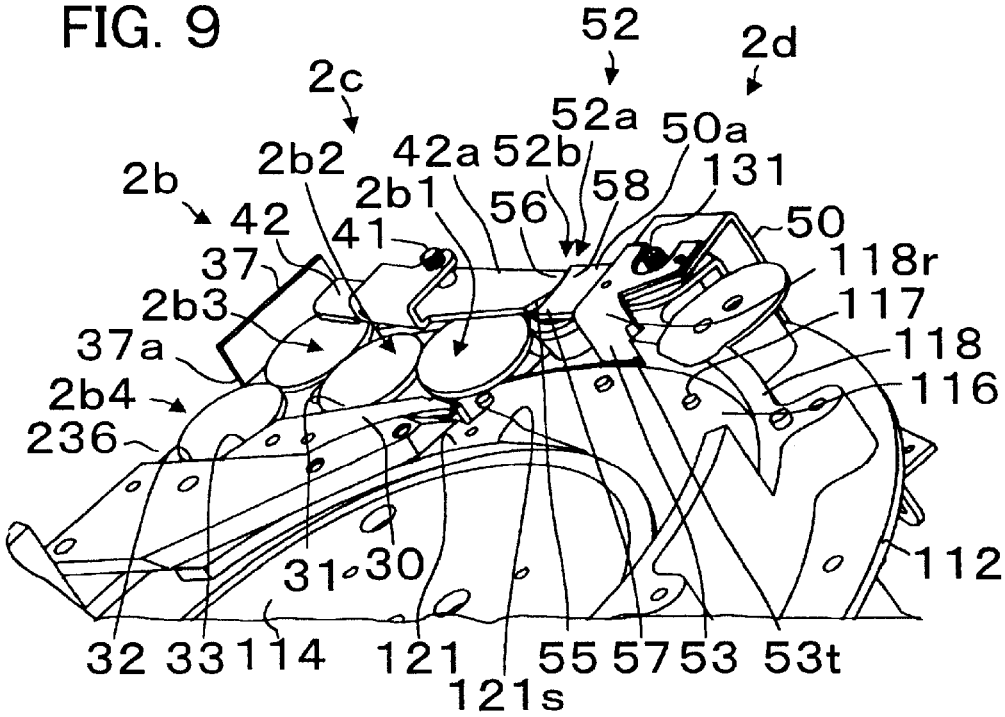
FIG. 9 is a perspective view of the second embodiment with coin blockage.

If however there is a blockage or obstruction the coin exit 236 will close as shown in FIGS. 8 and 9. The first coin z1 is located at a third passage 2*b*3 and fourth passage 2*b*4. The second coin z2 will be located at the third passage 2*b*3 because it is stopped by the first coin z1. The third coin z3 is located at the second passage 2*b*2 and first passage 2*b*1 because it is stopped by the second coin z2. As the pin 117 rotates the fourth coin z4 is moved from the top surface 121*s* of the knife member to the middle section 121*m*. Thus, the fourth coin z4 will be located at upper surface 51*b* of the spacer as shown in FIG. 9. The second coin z2 will be pushed by the third coin z3 so that it will be pushed upward to the fourth guide 36 as in the first embodiment. As a result, the second coin z2 is pushed out to the detecting board 43 and the detecting lever 42 and lever 42*a* are moved in the clockwise direction. A projection 57 of lever 50*a* is pushed downward by the projection 55 and scraper member 53 is moved in the counter clockwise direction about the fixed shaft 131, as shown in FIG. 8. As a result, the end 53*t* moves into the depression 118*r* so that it will be located near the plane 116 of the rotating disk 114 to thereby divert any new coins and return them to storage in the hopper.

The fourth coin z4 moves to be near the guide 31 because the second coin z2 moves towards the fourth guide 36. As a result, the fourth coin z4 is located at the offset position which is slightly raised above the pin 117 because the coin is located on the upper surface 51*b* of the spacer 51. Therefore, the pin 117 can rotate without contacting the fourth coin z4 and the rotating disk 114 can continue to rotate. In addition, the detecting lever 42 continues to the position shown in FIG. 8 because the second coin z2 is being cammed upward behind the first coin z1. At the diversion position, the coins will contact the end 53*t* and slant 53*m* so that they will be returned to the coin bowl and will not be counted by contacting the count roller 133, again the maximum discharge of coins will only be four and they will be recorded.

Figure 10:
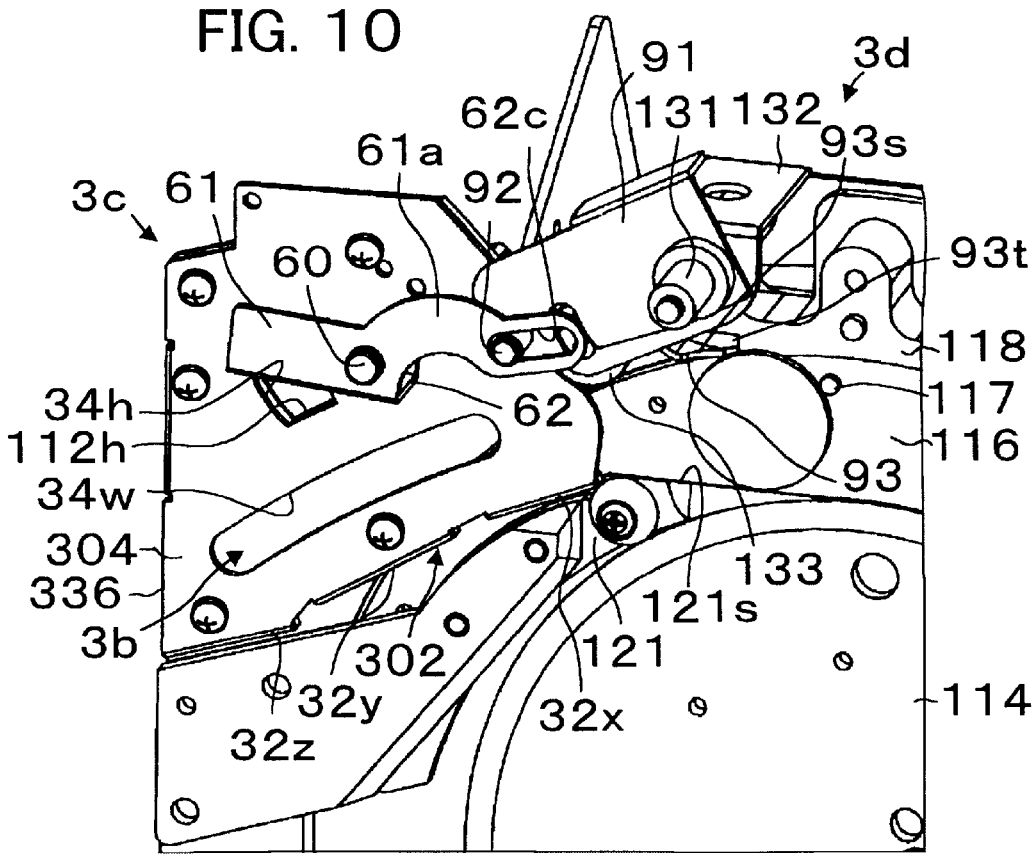
FIG. 10 is a partial perspective view of the third embodiment of the present invention.
Figure 11:
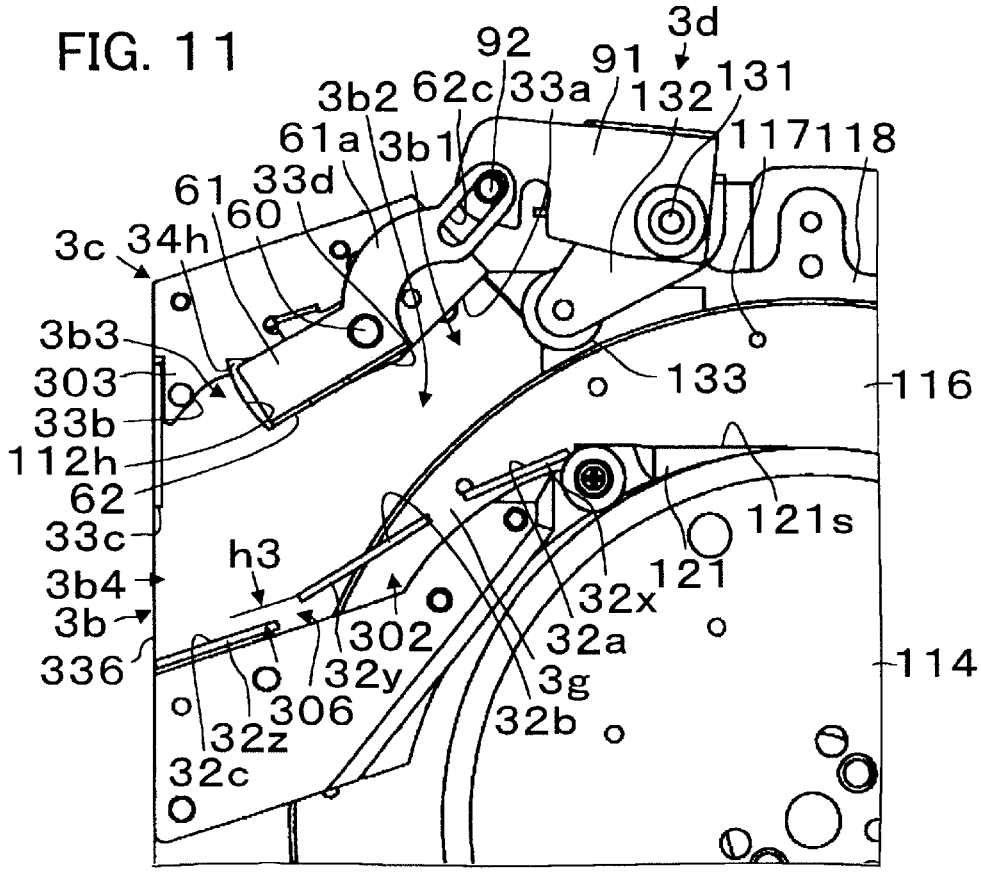
FIG. 11 is a plan partial view with the cover removed of the third embodiment.
Figure 12:
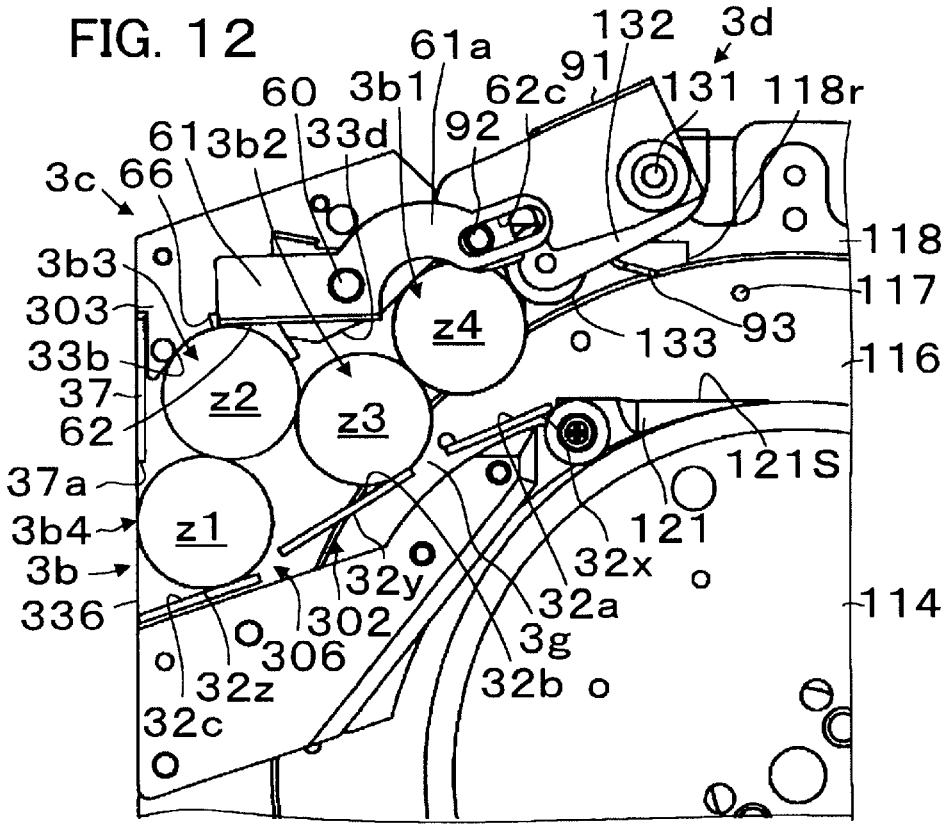
FIG. 12 is a plan partial view with the cover removed showing coin blockage.

A third embodiment of the present invention is disclosed in FIGS. 10–12. In this embodiment the lower guide section 302 is covered by a cover 304 that extends across a rotating disk 114 and the hopper base 112. The lower guide section includes a first guide member 32*x* which extends traverse to the plane 116, a second guide section 32*y* which also extends traverse to the plane 116 and a detecting guide 32*z* which is traverse to the hopper base 112. A first guide surface 32*a* is provided on the first guide section 32*x* and is both straight and slanted to the left in a downward direction. A second guide surface 32*b* is provided on the guide section 32*y* and it is also straight and slanted to the left. It is also offset to provide a gap with a first guide surface 32*a*. Detecting guide surface 32*c* is the upper surface of the detecting guide 32*z* and it is also straight and slanted to the left and position below by the increment h3 shown in FIG. 11 from the guide surface 32*b*. An upper guide member 303 has a concave arc section 33*b* and a vertically extending downward board 37. The upper guide surface also includes a straight portion 33*d* with a slant angle smaller than the second guide surface 33*a*. The detector unit 3*c* includes a pivoting detector lever 61 that pivots around the shaft 60 that is fixed on the cover 304. The lower edge of the detecting lever 61 has a detecting piece 62 which protrudes at the side of the hopper base 112, as shown in FIG. 10. The detecting lever 61 is bias in a counter clockwise direction by a spring not illustrated. An elongated hole 112*h* which is similar in shape to a elongated hole 34*h* is formed in the hopper base 112. Detecting piece 62 is inserted between elongated hole 112*h* and elongated hole 34*h* so that it is located within the third passage 3*b*3.

Elongated hole 34*w* is opened at the cover 304 along the coin passage 3*b*3 to provide a visual observation of the coin positions. A diverter device 3*d* is connected to the detecting lever 61 by a pin 92 extending into a elongated hole 62*c*. The lever 91 is adapted to swing about the fixed shaft 131 and to supports at one end, scraper 93 having an end 93*t* in a triangular shape.

When lever 91 is moved in a counter clockwise direction the scraper 93 is moved into a depression 118*r* and slant surface 93*s* is positioned near the plane 116 as shown in FIG. 10. The inclination of the slanted surface 93*s* is to direct a coin away from the rotating direction of plane 116.

In the third embodiment when coins are being normally ejected a detector lever 61 is bias in the counter clockwise direction by the spring. The detecting piece 62 is in contacted with the lower edge of the elongated hole 34*h* and 112*h* at this position the detecting piece does not have contact with coins as they are normally guided by the guide 62. Additionally, the pin 92 is pushed up by link lever 61*a*, as shown in FIG. 11. Therefore the lever 91 moves in a clockwise direction. The end 93*t* of the scraper 93 is located away from the plane 116. During rotation of the disk 114, a coin will move from the plane 116 on the rotating disk 114 to top surface 121*s* of the knife member 121.

As the coin moves from the top surface 121*s* to the first guide 32*a* it passes between the knife member 121 and the count roller 133. The count roller 133 is pushed by the coin so that a sensor detects the ejection of a coin and outputs a detecting signal. The coin then rolls to the respective guide surfaces 32*a*, 32*b* and 32*c* so that it will also respectively pass through the first passage 3*b*1, second passage 3*b*2, the third passage 3*b*3 and fourth passage 3*b*4 to be discharged by the coin exit 336.

If the coin exit 336 is blocked, a first coin z1 as shown in FIG. 12 will be held between the third passage 3*b*3 and fourth passage 3*b*4. A second coin z2 will be located at the third passage 3*b*3 on the guide surface 32*b*. A succeeding third coin z3 will be located at the second passage 3*b*2 and the first passage 3*b*1.

As the fourth coin z4 is pushed by the pin 117 it will be urged upward from the top surface 121*s* and the first guide surface 32*a* so that the second coin z2 will be forced upward into the compartment or hole 33*b* and into contact with the detecting piece 62. The detecting piece 62 will be elevated upward so that the detecting lever 61 and link lever 61*a* are moved in a clockwise direction. Lever 91 likewise moves in a counter clockwise direction because the pin 92 is pushed downward. As a result, the end 93*t* of the scraper 93 is moved into the depression 118*r* so that it is near the plane 116 and is now in a diverter position, see FIG. 12.

The fourth coin z4 is also moved upward near the second guide surface 33*a* when the second coin z2 is moved toward the depression 33*b*. The fourth coin z4 is kept in this position by the third coin z3 and the count roller 133, as shown in FIG. 12. As can be determined, the rotating disk 114 can continue to rotate because the pin 117 will pass below the surface of the fourth coin z4. Because the second coin z2 is held by the first coin z1 the detecting lever 61 continues to be held in the position shown in FIG. 12 and any new coins attempting to enter the coin passage way will contact the slanted surface 93*s* at the end 93*t* and will fall back into the coin bowl 119 before it can reach the count roller 133. Again, the maximum discharge of coins will only be four which will be counted.

A fourth embodiment is disclosed in FIGS. 13, 14, 15 and 16.

Figure 13:
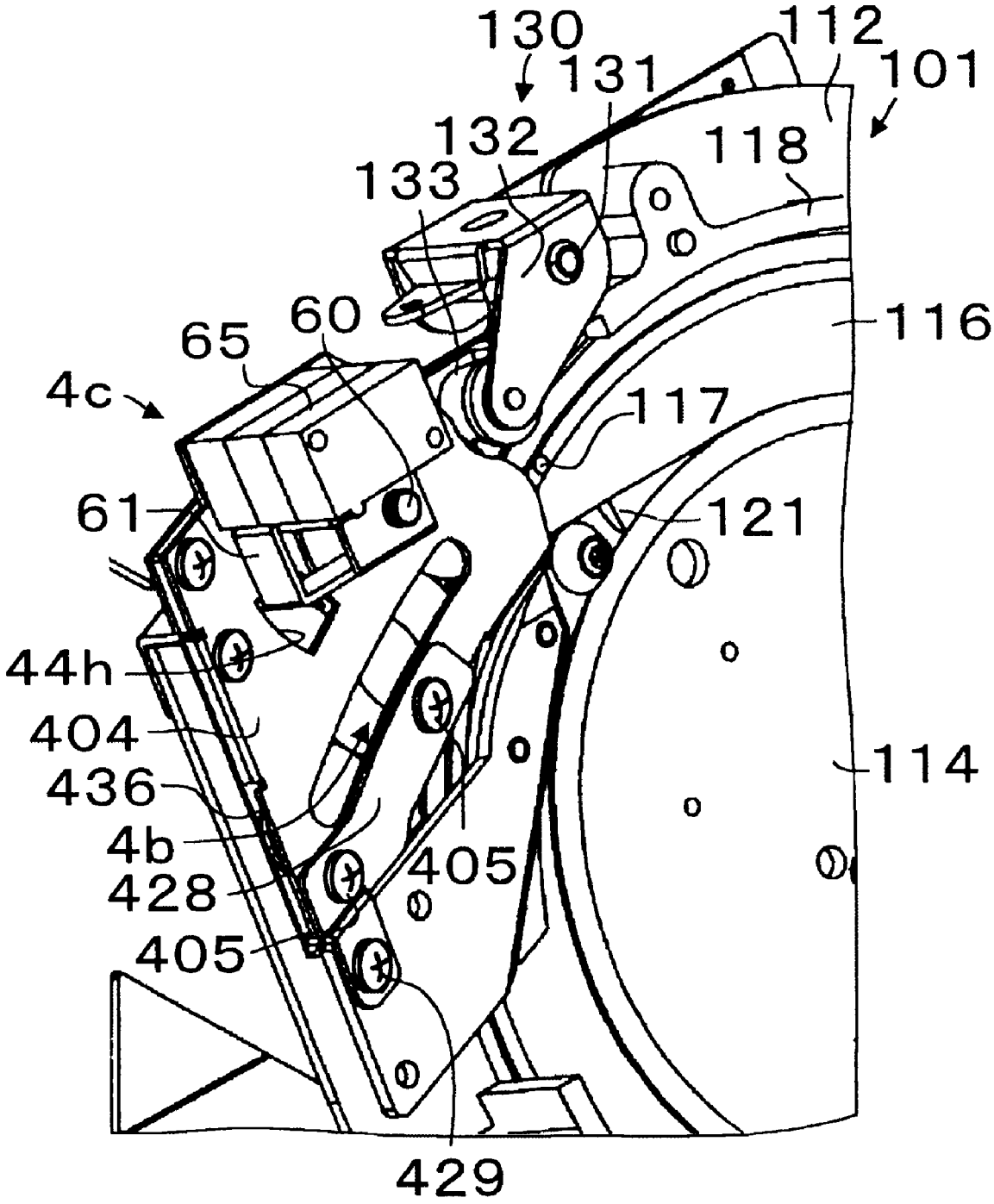
FIG. 13 is a partial perspective view of the fourth embodiment of the present invention.
Figure 14:
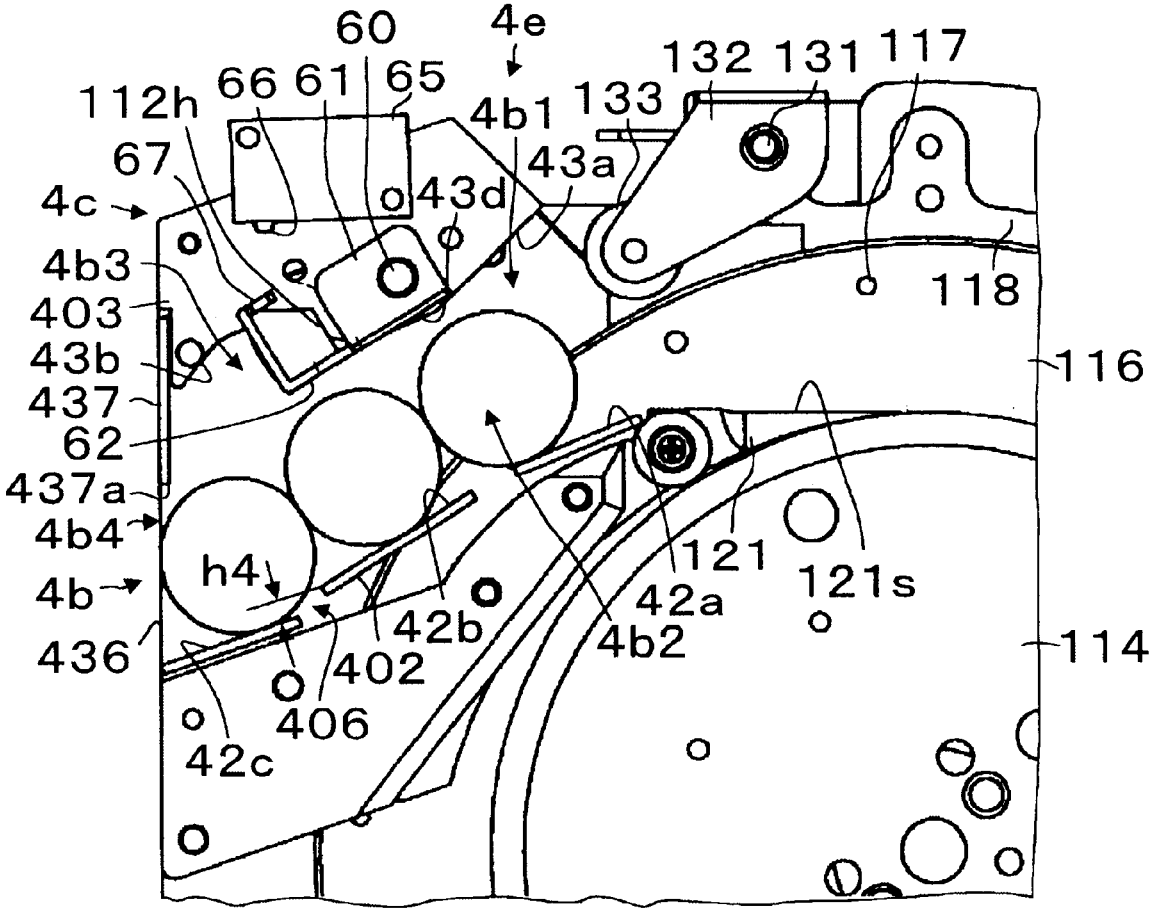
FIG. 14 is a partial plan view with the cover removed of the fourth embodiment with coins in transit.

Referring to FIG. 13 a switch member 65 is fixed to the cover 404 and it is arranged so that if a detecting lever 61 moves in a clockwise direction an operational member of the switch 65 will be pushed by the pusher 67, see FIG. 14.

Figure 16:
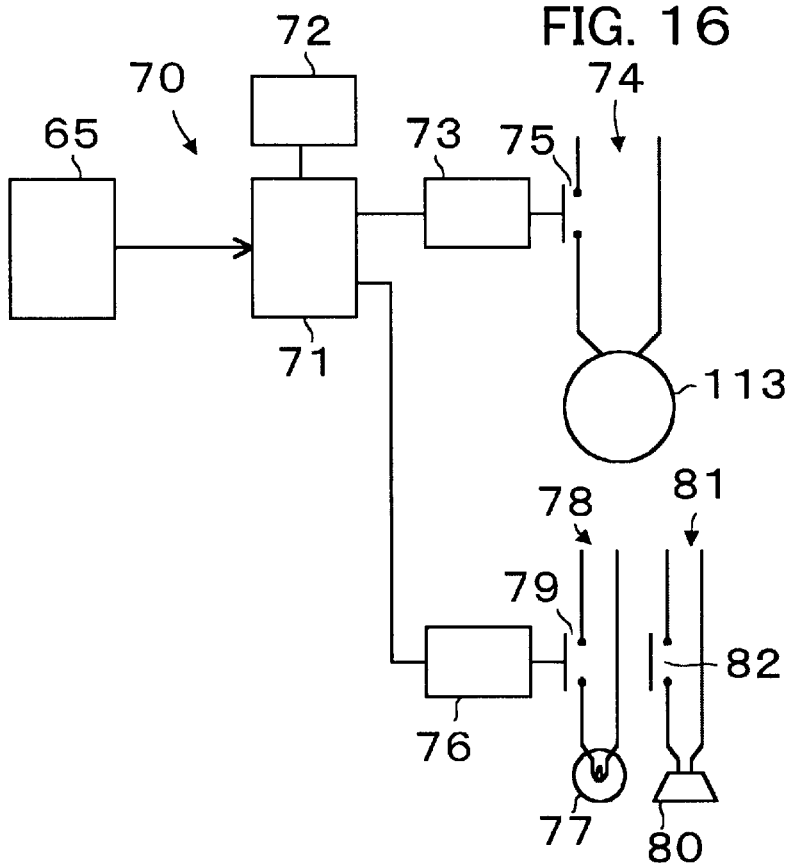
FIG. 16 is a schematic diagram of the control circuit of the fourth embodiment.

Referring to the control circuit shown schematically in FIG. 16 the control device 70 includes a distinction circuit 71 that is adapted to receive a signal from the switch 65. When switch 65 is activated the distinction circuit 71 will output a stop signal. The distinction circuit 71 can be changed by a microprocessor, not shown, so that it is reset by a reset switch 72. The output from the distinction circuit 71 can be directed to a control circuit 73 that controls an electric motor 113. When the distinction circuit 71 outputs a stop signal, a contact 75 of the power circuit 74 is open by the motor control circuit 73. An alarm control circuit 76 can also receive a signal from the distinction circuit 71. The contact 79 and 82 are opened and closed by the alarm control circuit 76. Contact 76 and the control circuit 78 activates an alarm lamp or visual signal 77 while contact 82 in the power circuit 82 activates an audio alarm speaker 80.

In the operation of the fourth embodiment, a detecting piece 62 can be journaled for contacting the lower edge opening of 44*h* as shown in FIGS. 13 and 14. When a coin moves from the rotating disk 114 to the top surface 121*s* of knife it will be moved in the left direction across the top surface by the pin 117. The count roller 133 will be pushed up by coin to detect the present of a coin when the lever 132 is moved in a clockwise direction. The coin will then roll across a guide 42*b* to pass through the first passage 4*b*1 and the second passage 4*b*2. The coin further rolls across a gap 406 and across the detecting guide 4*c* to pass through a third passage 4*b*3. As the coin passes through the third passage 4*b*3 it will not contact with the detecting piece 62 because it is located in a position away from the coin diameter. The coin then passes through the fourth passage 4*b*4 and is discharged from the coin exit 436.

Figure 15:
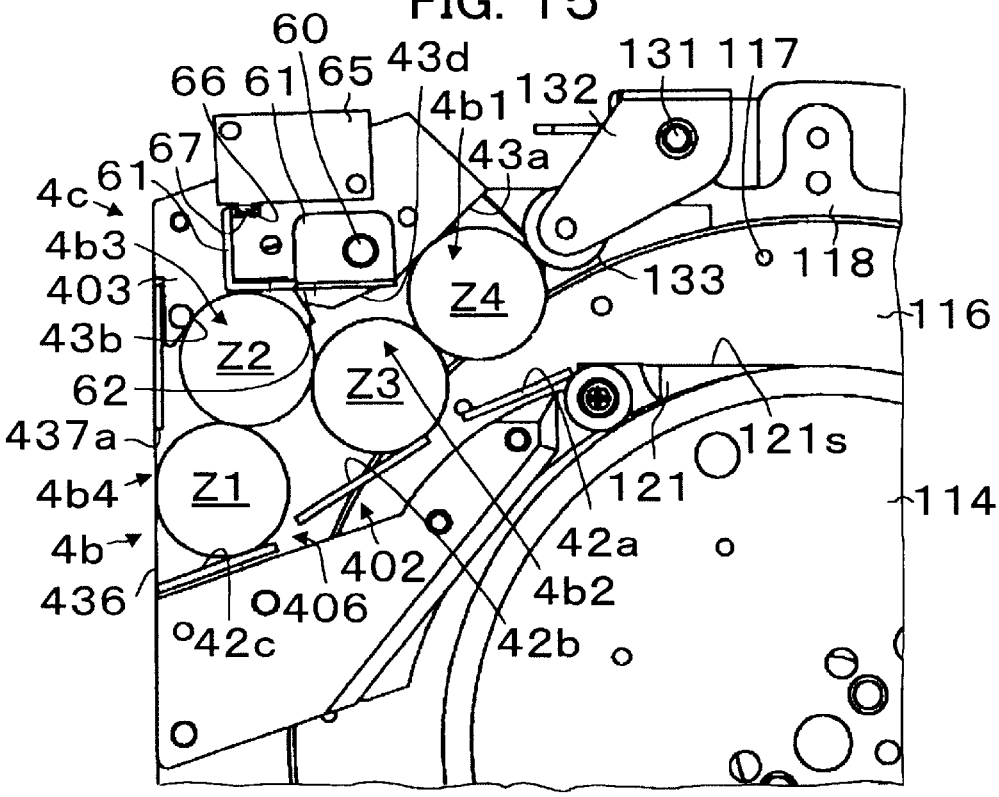
FIG. 15 is a partial plan view with the cover removed of the fourth embodiment with coin blockage.

If the coin exit is blocked as shown in FIG. 15, the second coin z2 is pushed towards a depression or compartment 43*b* above the second passage 4*b*2 as in the first embodiment. As a result, the detecting piece 62 is pushed up by the second coin z2 and the detecting lever 61 moves around a pivoting shaft 60 in a clockwise direction. The switch 65 is activated because its operation piece 66 is pushed by the pusher 67.

When the distinction circuit 76 receives a signal from the switch 65, the circuit outputs an stop signal to the motor control circuit 73 and activates the alarm control circuit 76. Contact 75 is opened by the motor control circuit 73 which receives the stop signal. The motor 113 and the rotating disk 114 stop. Additionally, the alarm lamp 77 is turned on because the contact 79 is closed by the alarm control circuit 76.

A fifth embodiment of the present invention is disclosed in FIGS. 17, 18, 19, and 20. In this embodiment, there is a detecting lever 511 located adjacent the coin exit. Like the earlier embodiments, a succeeding coin can be elevated up to a storage compartment above the coin passageway surface and can activate a series of levers to provide a detection signal of coin blockage and to activate the placement of a diverter member to prevent the entrance of additional coins into the coin passageway.

Figure 18:
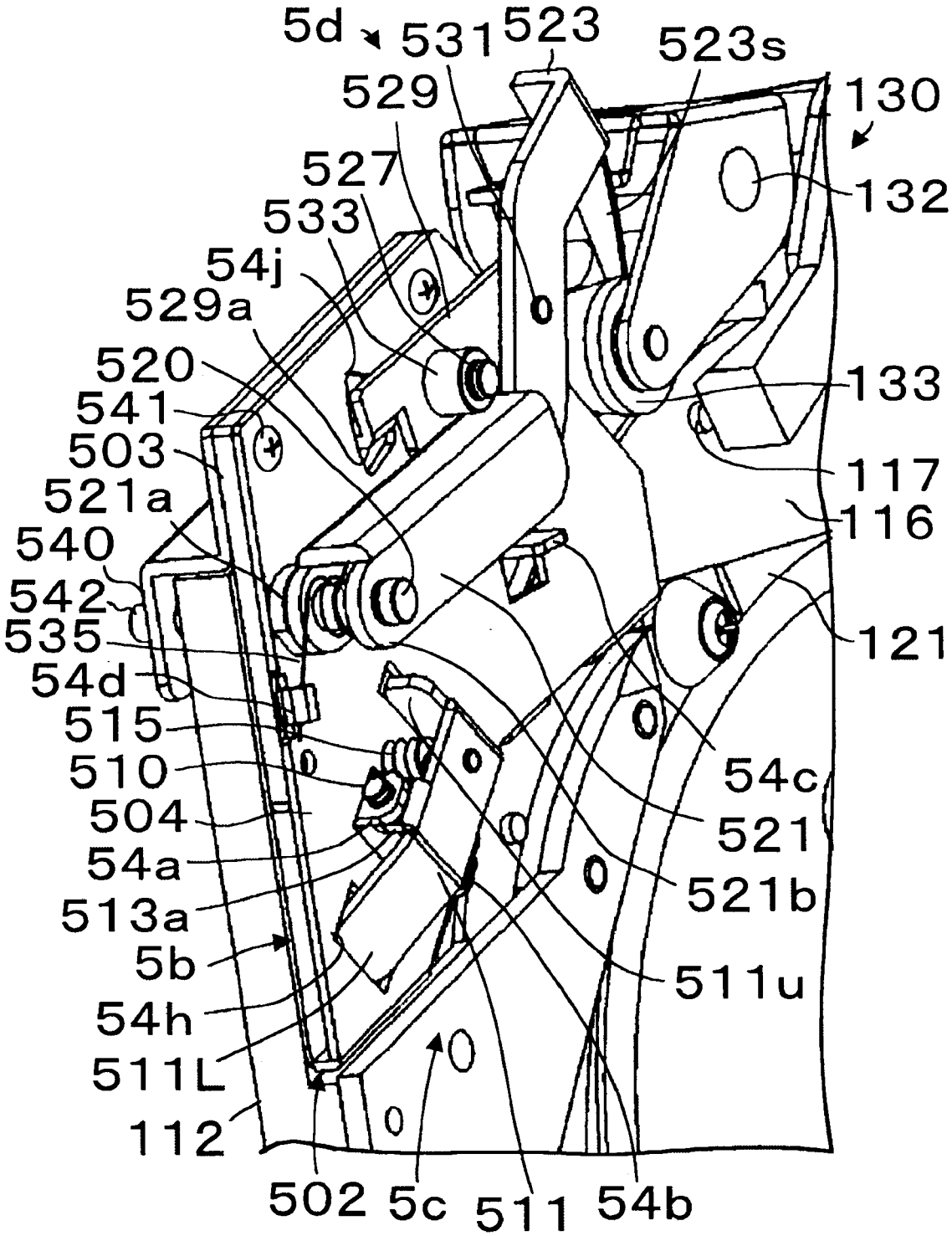
FIG. 18 is a partial perspective view of the fifth embodiment of the present invention.
Figure 19:
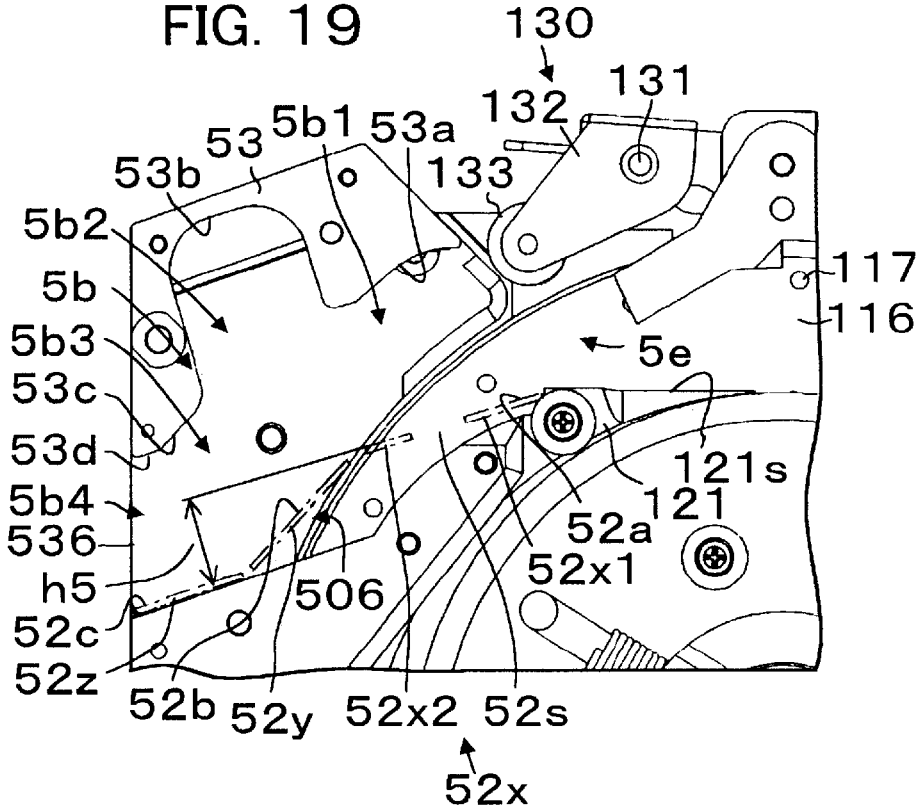
FIG. 19 is a partial plan view of the fifth embodiment of the present invention.

Coin passage 5*b* includes the hopper base 112, lower guide 502, upper guide 503, and cover 504. The coin passage 5*b* slants downwards to the left. A lower guide 502 includes the lower bend portion of the cover 504 which is directed towards a rotating disk 114 and the hopper base 112, as shown in FIG. 18. This bend portion is slightly thicker than a coin. The lower guide 502 includes a first guide 52*x*, a guide piece 52*y*, and a detecting guide 52*z*. The first guide 52*x* is adjacent the supporting plane 116, while guide piece 52*y* is adjacent the hopper base 112, as shown by the dotted line in FIGS. 19 and 20. The first guide 52*x* includes separated first guide piece 52*x*1 and second guide piece 52*x*2 that are both slanted downward towards the coin exit 536 from the upper knife surface 121. A gap or passageway 52s exists between the first guide piece 52*x*1 and the second guide piece 52*x*2 to permit the passage of the pin 117. A first guide 52*a* is the upper surface of the first guide piece 52*x*1 and the second guide piece 52*x*2.

The first guide 52*a* slants downwards to the left and continues to an upper surface 121*s*. The guide 52*b* is the upper surface of guide 52*y* and has a slanted angle which is larger than the first guide 52*a* and slants downwards to the left. The detecting guide 52*c* is the upper surface of a detecting guide piece 52*z* and is slanted slightly larger than the first guide 52*a*. Guide 52*b* has the largest slant and the extension line of guide 52*b* crosses at detecting guide 52*c*. A gap 506 is between the first guide 52*a* and the detecting guide 52*c* and is differentiated by the height h5. This embodiment is inexpensive, because it can be manufactured by press forming metal sheets.

The thickness of the upper guide is the same as the lower guide 502 and is larger than the thickness of one coin and is smaller than the thickness of two coins. The upper guide 503 includes a second guide 53*a*, a depression guide 53*b*, a third guide 53*c*, and a fourth guide 53*d*. The second guide 53*a* faces the first guide 52*a* and the slant is larger than the first guide 52*a*. Guide 53*b* faces the guide 52*b* and has a trough-like shape. The third guide 53*c* faces the detecting guide 52*c* and its slant is larger than the detecting guide 52*c*. The fourth guide 53*d* is parallel to the detecting guide 52*c* and it continues to the third guide 53*c*.

The coin passage 5*b* includes an entry passage 5*b*1, a drive passage 5*b*2, a third passage 5*b*3, and an exit passage 5*b*4. The entry passage 5*b*1 is trapezoid-like in shape and the vertical direction is defined by the first guide 52*a* and the second guide 53*a*. The vertical direction of the drive passage 5*b*2 is defined by the guide 52*b* and guide 52*b* and it is higher than the other passages. The vertical direction of the third passage 5*b*3 is defined by the detecting guide 52*c* and the third guide 53*c* and it is trapezoid-like in shape. The vertical direction of exit passage 5*b*4 is defined by the detecting guide 52*c* and the fourth guide 53*c*. The coin exit 536 is at the edge of the opening of the exit passage 5*b*4. The coin passage 5*b*4 slants downward to the left and has an upward branch passage and is Y-like in shape. The thickness of the passage 5*b* is smaller than the thickness of two coins.

The detector 5*c* includes a detecting lever 511 which moves around a shaft 510 fixed to brackets 54*a* and 54*b* of a cover 504. The shaft bearing 513*a* and 513*b* of the detecting lever 411 moves around the shaft 510. The lever 511 is located along the third passage 5*b*3. The lower edge 511L of the lever 511 is bent toward the cover 504 and it can go into the third passage 5*b*3 and exit passage 5*b*4 through a detecting opening 54*h*. A stopper 511*u* is formed at the upper edge of the detecting lever 511 and it is bent towards a hopper base 112. The stopper 511*u* can go into the drive passage 5*b*2 through a stopper opening 54*s* of the cover 504. A spring 515 is located between the cover 504 and the detecting lever 511 and it biases, in the clockwise direction, lever 511 shown in FIG. 18.

The lower end 511L of the detecting lever 511 contacts the hopper base 112 through the detecting opening 54*h*, third passage 5b3, and exit passage 5b4. The center of the coin which rolls on the detecting guide 52c passes through the position of the lower end 511L. At this point, the stopper 511u is moved from the driving passage 5b2. The detector 5c of this embodiment is at the lower end 511L of the detecting lever 511.

A diverter 5d is now explained.

A fixed shaft 520 is fixed to cover 504 above detecting opening 54h. The base of the diverting lever 521 moves about the fixed shaft 520. The diverting lever 521 has a base of a channel-like shape. Side boards 521a and 521b of the diverting lever 521 pivot around the fixed shaft 520. The triangular end of the diverting lever 521 is located upstream of a count roller 133. The end surface is a diverter 523 which is slanted upwards towards the surface of a rotating disk 114.

When the diverter 523 is moved in a clockwise direction by a piece 529a, the triangular end moves into the coin transport passage 5e and is located near the rotating disk 114. The coin transport passage 5e is a coin passage for a coin which is transported by the rotating disk 114. At this point, the slant 523s is located away from a plane 116 of the rotating disk 114.

A driven lever 529 can pivot around a third shaft 527 which is fixed to the cover 504. A driven piece 529a is at the end of the driven lever 529. The end of the fixed shaft 20 side of the driven lever 529 is bent toward the hopper base 112. The end is located in the drive passage 5b2 through an opening 54j in the cover 504. A pin 531 is connected to the other end of the driven lever 529 and the middle of the diverter lever 521. A bush 533 can rotate on a third shaft 527. The diverter lever 521 is biased in the counterclockwise directing in FIGS. 17 and 18 by a spring 535.

An upper guide 503 is sandwiched between the cover 504 and the support 540 and is fixed by a screw 541. A support 540 is crank-like in shape. This component is covered by the hopper base 112 and is fixed to the hopper base 112 by a screw 542. The cover 504 composes the coin passage 5b which continues with plane 116.

Figure 17:
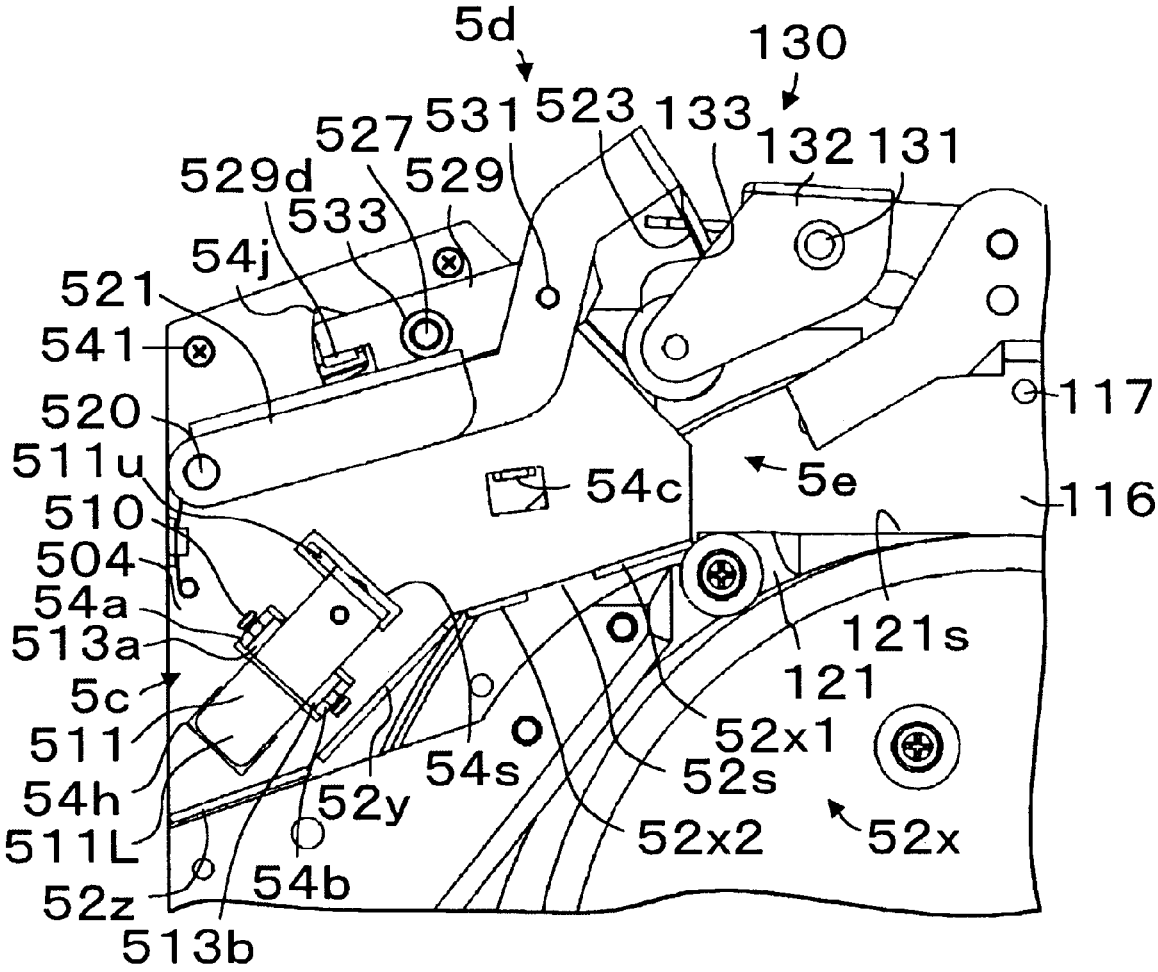
FIG. 17 is a plan view of the fifth embodiment of the present invention.

The normal operation of the fifth embodiment is shown in FIG. 17. The detecting lever 521 is stopped from movement in a counterclockwise direction by bush 533. The end of the diverter 523 is located away from the rotating disk 114 and it does not contact with a coin. The driven lever 529 moves in the counterclockwise direction by detecting the lever 521 through the pin 531. The driven piece 529a is located near the lower end of the opening 54j. In this situation, the driven piece 529a does not contact a coin which rolls on the guide 52b. The detecting lever 511 is stopped, because the lower end of the detecting lever contacts the hopper base 112.

When the rotating disk 114 rotates, a coin moves from the plane 116 of the rotating disk 114 to the top surface 121s of a knife 121. The coin moves to the left of the top surface 121s by a pin 117 and under the diverter 523, because the diverter is located away from the coin. Then coin then moves from the top surface 121s to a first guide piece 52x1 of the first guide 52x, as it is pushed by the pin 117. The coin pushes up to the count roller 133. A sensor detects that the roller 133 has been pushed and outputs a detecting signal. The coin rolls on the second guide piece 52x2 and it passes the entry passage 5b1. The entry passage 5b1 has a trapezoid shape with an upside size larger than the downside size in the direction towards the upstream.

After the coin is counted by the count roller 133, the coin is guided into the entry passage 5b1 and is guided by the second guide 53a. Next, the coin passes the drive passage 5b2 and the third passage 5b3. The coin rolls on the detecting guide 52c and is dispensed from an exit 536 through the exit passage 5b4. When the coin passes the third passage 5b3 and the exit passage 5b4, the coin pushes up the lower end 511L of the detecting lever 511 which is biased by spring forces. After the coin passes, the detecting lever 511 moves in a clockwise direction and is stopped by the hopperbase 112.

Figure 20:
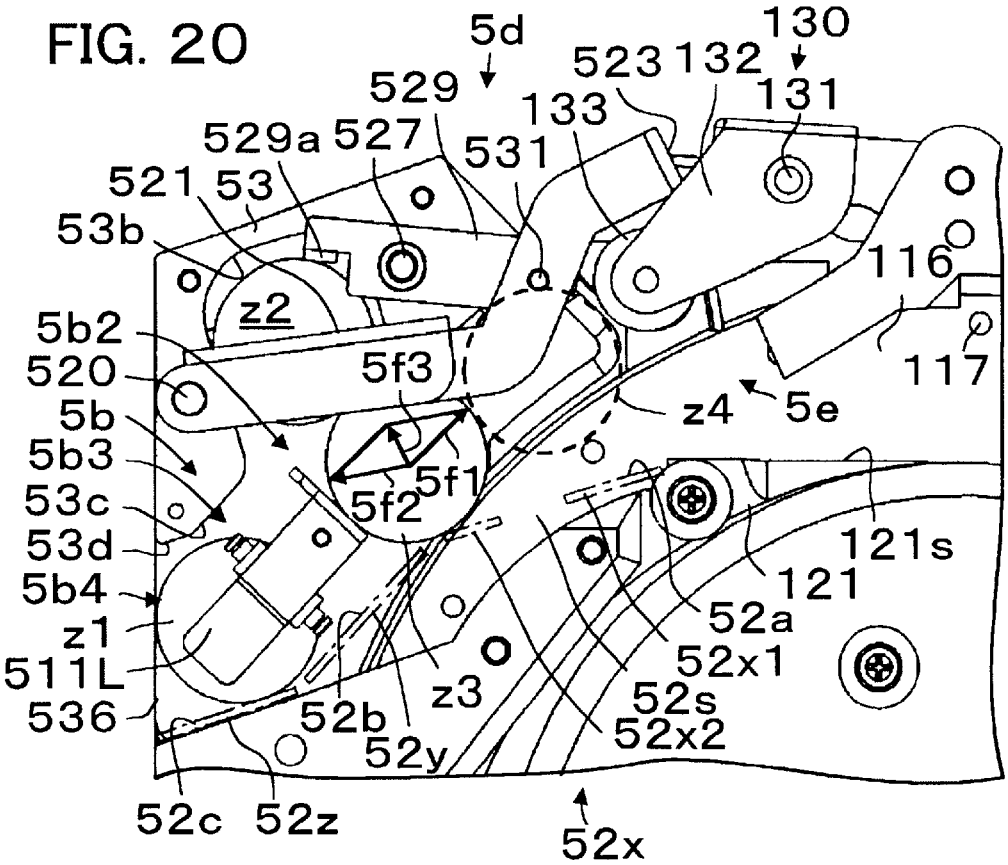
FIG. 20 is a partial plan view of the fifth embodiment with the cover removed showing coin blockage.

If a person or an object tries to obstruct this process by closing the exit 536, shown in FIG. 20, the first coin z1 locates in the third passage 5b3 and the exit passage 5b4. The lower end 511L of the detecting lever 511 is pushed up by the first coin z1. The detecting lever 511 moves around the shaft 510 in a counterclockwise direction, as shown in FIG. 18. Therefore, the stopper 511u protrudes into the drive passage 5b2 and the coin contacts a guide piece 52x2, a second coin z2 is located at the entry passage 5b1 and the drive passage 5b2. A third coin z3 rolls on the first guide piece 52x1 and is stopped by the second coin z2 and is positioned in the entry passage 5b1. Consequently, the pin 117 pushes up the third coin z3 and passes below the third coin z3. At this point, the second coin z2 does not move.

Next, a fourth coin z4 is moved from the top surface 121s to the first piece 52x1 and pushes the third coin z3 to the left in FIG. 20. The third coin z3 is guided by the second guide 53a and pushes the coin z2 to the left. As a result, the second coin z2 receives an opposite force 5f1 towards the contact point of the second coin z2 and the third coin z3 from the stopper 511u. In addition, the second coin z2 receives a force 5f2 towards the center of the second coin z2 from the contact point between the second coin z2 and the third coin z3. The second coin z2 is pushed towards the depression guide 53b by the resultant forces 5f3 between the forces 5f1 and the force 5f2. The driven lever 529 is moved in a clockwise direction and depresses pin 531.

The diverter lever 521 is moved in the clockwise direction and is stopped by the stopper 54c. As a result, the top of the diverter 523 is located at the diverter position which is near the plane 116. The second coin z2 is located at the position in FIG. 20 by the guide 53b and the driven piece 529a and the diverter lever 521 is held in position, as shown in FIG. 20. The fourth coin z4 is pushed by the pin 117 to move on the first guide piece 52x1, because the second coin moves toward the guide 53b. However, the rotating disk 144 continues its rotation, because the fourth coin z4 is moved to the second guide 53a and the pin 117 passes below the fourth coin z4.

When the diverter 523 is located at the diverting position, the coin contacts a slant 523s and the upper part of the coin is pushed towards a coin bowl 119. As a result, the coin falls from the upper surface 121s and does not go to the count roller 133.

A sixth embodiment is explained by FIGS. 21, 22, 23, 24, 25, 26 and 27.

A coin passage 6b slants downwards to the left and includes the hopper base 112, a lower guide 602, an upper guide 603, and a cover 604. The lower guide 602 is formed by the lower end of the cover 604 which is bent towards the rotating disk 114. The length of the lower guide 602 is larger than the thickness of one coin. At this point, the movement of the third coin z3 is not interrupted by the upper guide 603, because the upper guide 603 is far enough away from the guide 62b and the rotating disk 114 continues to rotate with the third coin z3 being moved by the pin 117 whenever the pin 117 passes. When the diverter 623 is located at a diverter position, the coins on the plane 116 contact with the slant 623s of the diverter 623 which is slanted in the opposite direction of the plane 116. The slant is in the vertical direction in the drawing. As a result, the top of a coin is lifted from the plane 116 by the slant 623*s* and is deflected to the coin bowl 119. The coin falls from the top surface of the knife 121*s* and does not reach the count roller 133.

Accordingly, if the exit is closed by a person or object, the coins are not choked up in the coin passage 6*b*. If the force to stop the first coin z1 is changed, the first coin z1 slightly protrudes from the coin exit 636 and the second coin z2 is located slightly downward, and the detecting lever 611 is slightly moved in the counterclockwise direction. However, until the stopper 611*s* contacts with the diverting lever 621, coins are not dispensed to the coin passage 6*b*.

Figure 26:
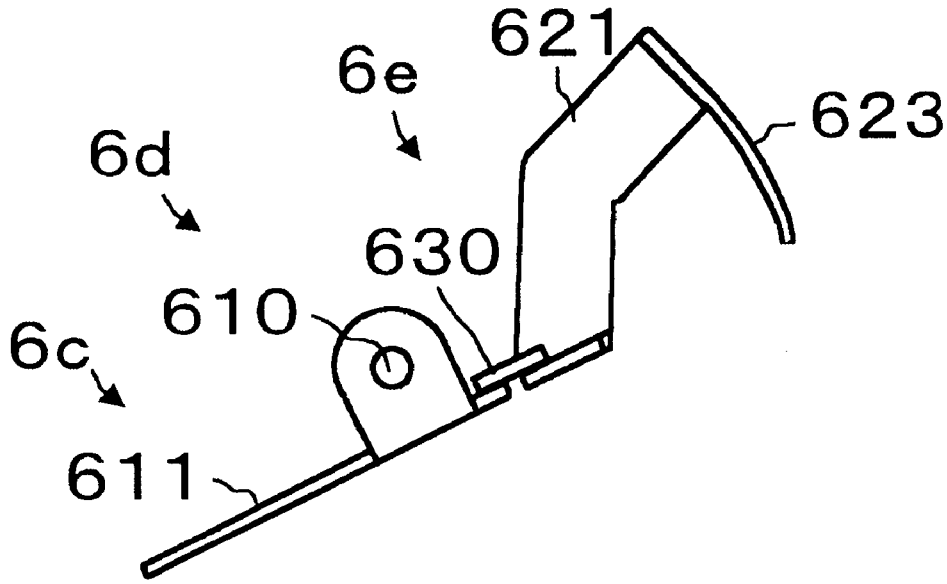
FIG. 26 is a side elevated view of a diverter.

In this embodiment, a flexible conjunction 6*e* has a function that the detecting lever and the diverter are moved as one at a predetermined position, and only the detecting lever is moved at another predetermined position. For example, the diverter 6*d* can connect and constitute the detecting lever 611 and a diverting lever 621 from a leaf spring 630, as shown in FIG. 26. The lower guide 602 includes a first guide piece 62*x*, a guide 62*y*, and a detecting piece 62*z*. The first guide piece 62*x* faces the plane 116 of the rotating disk 114. The guide 62*y* faces the hopper base 112 and the plane 116. The detecting piece 62*z* faces the hopper base 112. The first guide piece 62*x* and the guide 62*y* are located on a slant line which slants towards the coin exit 636. The pin 117 passes through a passage between the first guide piece 62*x* and the guide 62*y*. The first guide 62*a* is the upper surface of the first guide piece 62*x*. The first guide 62*a* slants downwards to the left and continues to the upper surface 121*s* of the knife 121. The second guide 62*b* is the upper surface of the guide piece 62*y*. The guide 62*b* slants at the same angle as the first guide 62*a*. The detecting guide 62*c* is the surface of the detecting piece 62*z*. The detecting guide 62*c* slants at a slightly smaller angle than the first guide 62*a*. The extension line of the guide 62*a* and the guide 62*b* cross at the extension line of the detecting guide 62*c*. A gap 606 is between the second guide 62*b* and the detecting guide 62*c* and is differentiated by the height 6*h*. This embodiment is also inexpensive, since the parts can be stamped by press forming.

The thickness of the upper guide 603 is the same as the lower guide 602. The upper guide 603 includes the second guide 63*a*, the depression guide 63*b*, the third guide or compartment 63*c*, and the fourth guide 63*d*. The second guide 63*a* faces the first guide 62*a* and the slant is larger than the first guide 62*a*. The guide 63*b* faces the first guide 62*a* and the guide 62*b* and is trough-like in shape. The third indented guide 63*c* faces the guide 62*b* and continues the guide 63*b*. The fourth guide 63*d* is the horizon exit and it continues the third guide 63*c*.

The coin passage 6*b* includes an entry passage 6*b*1, a drive passage 6*b*2, a third passage 6*b*3, and an exit passage 6*b*4. The entry passage 6*b*1 is trapezoid-like in shape and its vertical direction is defined by the first guide 62*a* and the second guide 63*a*. The vertical direction of the drive passage 6*b*2 is defined by the first guide 62*a* and the guide 62*a* and the second guide 63*a*. The vertical direction of the drive passage 6*b*2 is defined by the first guide 62*a* and the guide 63*b* and is shaped triangularly. The vertical direction of the third passage 6*b*3 is defined by the second guide 62*b* and the third guide 63*c* and is shaped like a trapezoid. The vertical direction of the exit passage 6*b*4 is defined by the detecting guide 62*c* and the fourth guide 63*d*.

The coin exit 636 is at the edge of the opening of the exit passage 6*b*4. The coin passage 6*b*3 has a saw-tooth like shape by the guide 63*b* and the third guide 63*c*. The thickness of the passage 6*b* is smaller than the thickness of two coins.

The operation of a detector 6*c* is explained.

An arc-shaped elongated hole 64*h* is formed to the cover 604 which faces the third guide 63*c*. The arc-shaped elongated hole 64*h* extends away from the direction of a gap 606, shown in FIG. 23. A fixed shaft 610 is fixed to the cover 604. The detecting lever 611 has a channel-like shape and includes a pair of side boards 611*a* and 611*b* and a connecting board 611*c*. The side boards 611*a* and 611*b* pivot around the fixed shaft 610. The connecting board 611*c* includes a detecting piece 614 which protrudes into a third passage 6*b*3 through the elongated hole 64*h*. The lower end of hole 64*c* contacts the detecting piece and stops the movement of the detecting piece 614.

When the detecting piece 614 is stopped by the elongated hole 64*h*, it does not make contact with the coins which pass through the third passage 6*b*3. The detecting piece 614 is a component of the detector 6*c*. The detector unit can use a detecting piece 614 which also attaches to a roller.

Figure 21:
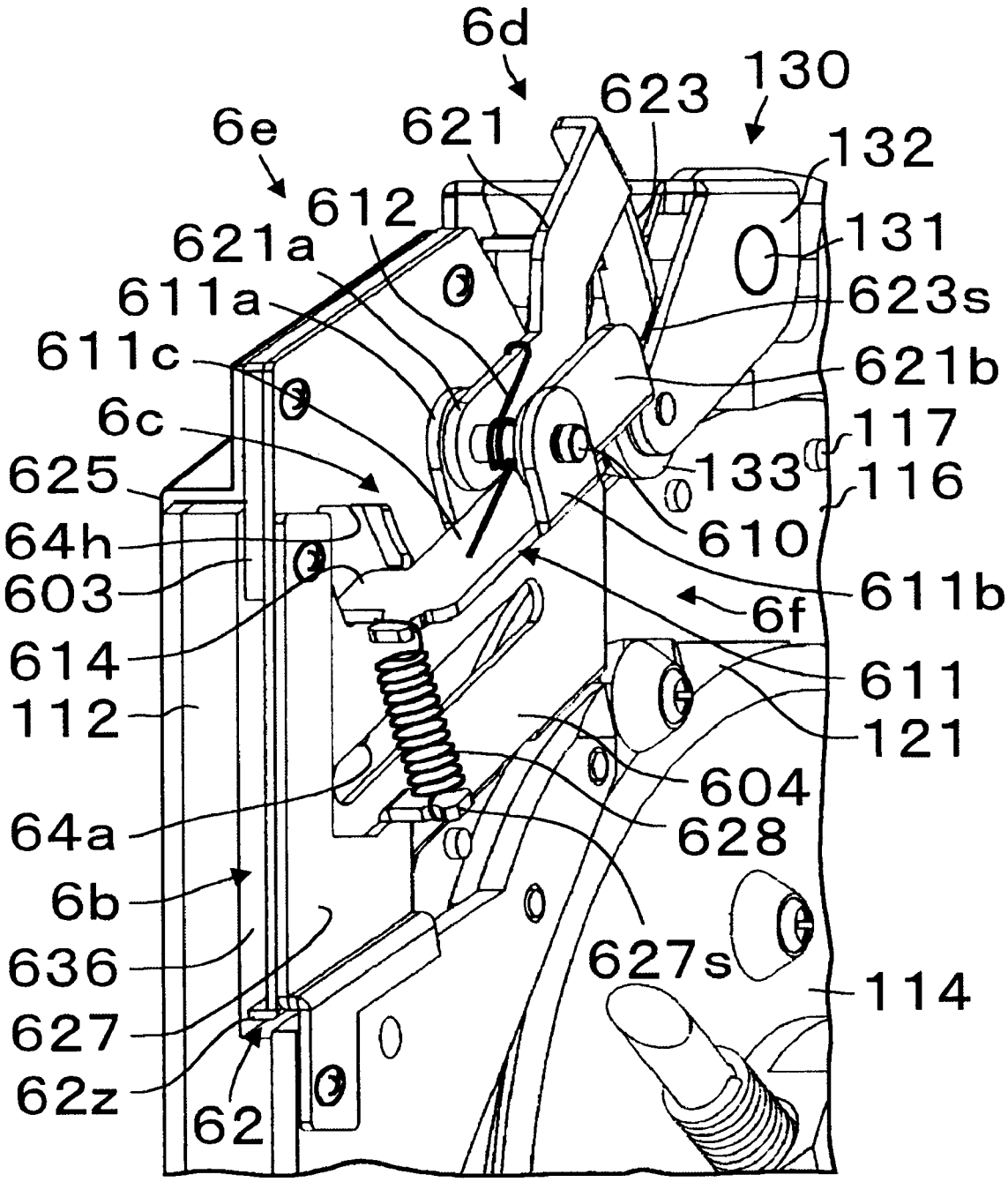
FIG. 21 is a perspective view of the sixth embodiment of the present invention.
Figure 22:
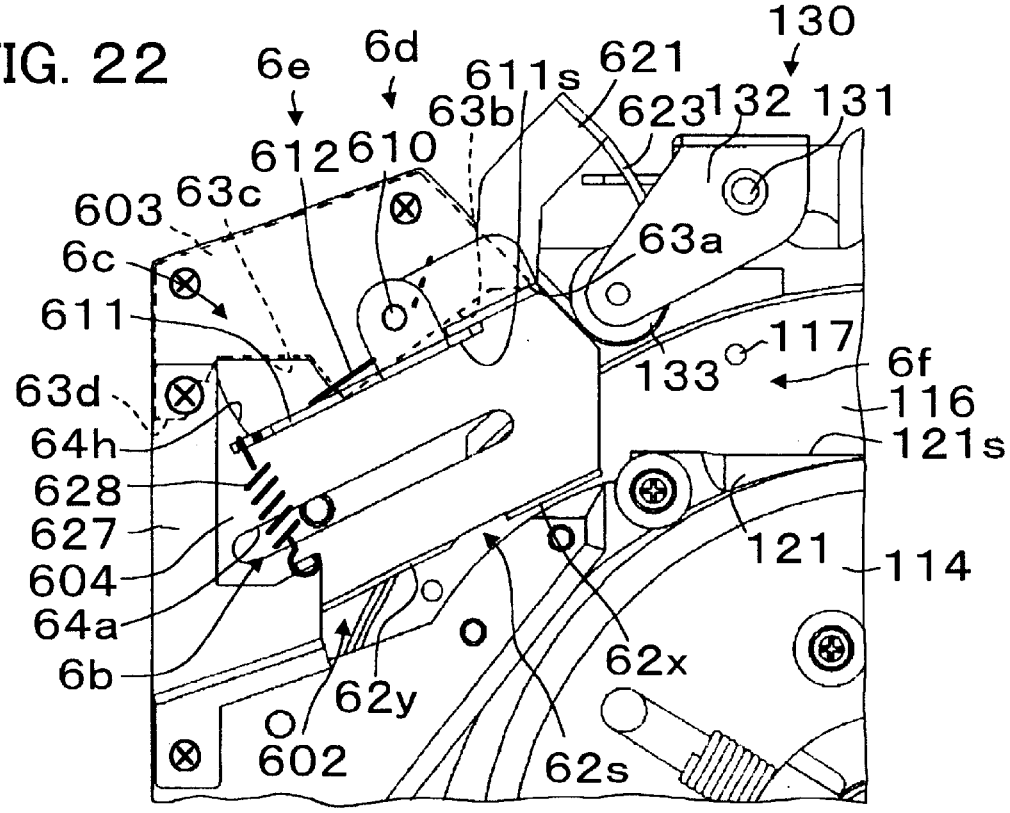
FIG. 22 is a partial plan view of the sixth embodiment of the present invention.
Figure 23:
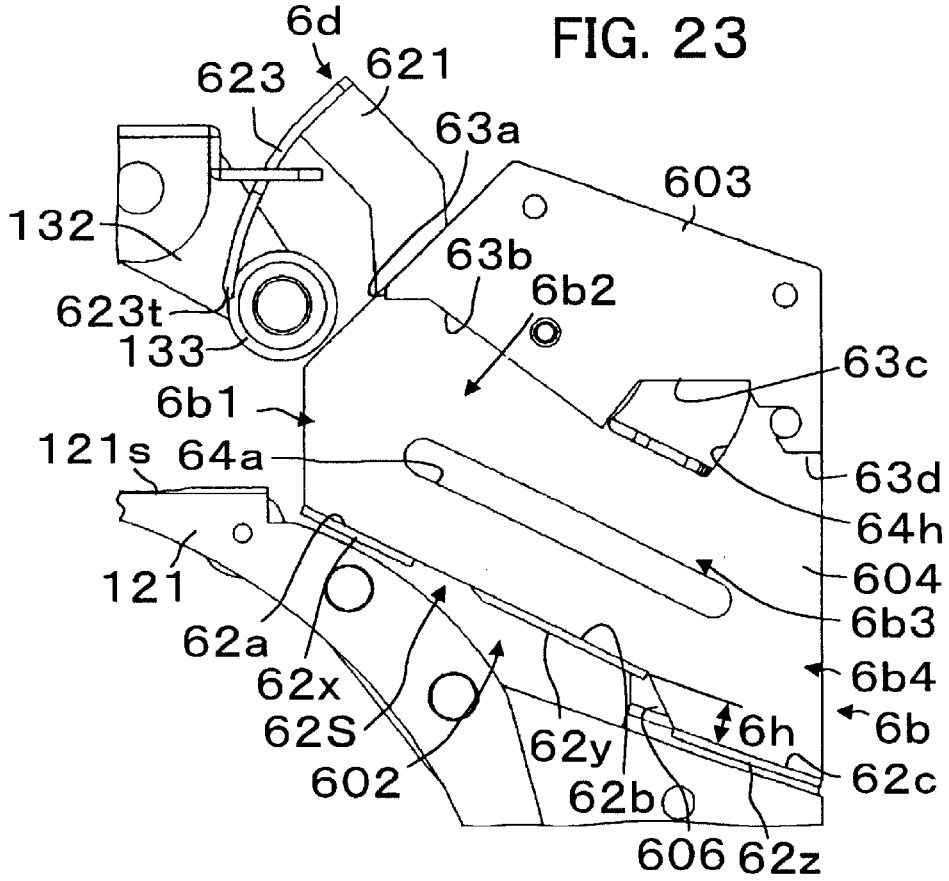
FIG. 23 is a partial rear plan view of the sixth embodiment.

A diverter 6d is explained with reference to FIGS. 21 and 22. The diverter 6*d* includes a detecting lever 611, a diverter lever 621, and a flexible conjunction 6*e*. The base of the diverting lever 621 can swing about the fixed shaft 610 and is channel-like in shape. The side boards 621*a* and 621*b* pivot around the fixed shaft 610. The end of the diverting lever 621 is triangular-like in shape and is positioned higher than the count roller 133. The diverter 623 is at the end of the diverting lever 621 and has a push up slant 623*s*. The slant slants away from the direction of the plane 116 of the rotating disk 114.

Figure 24:
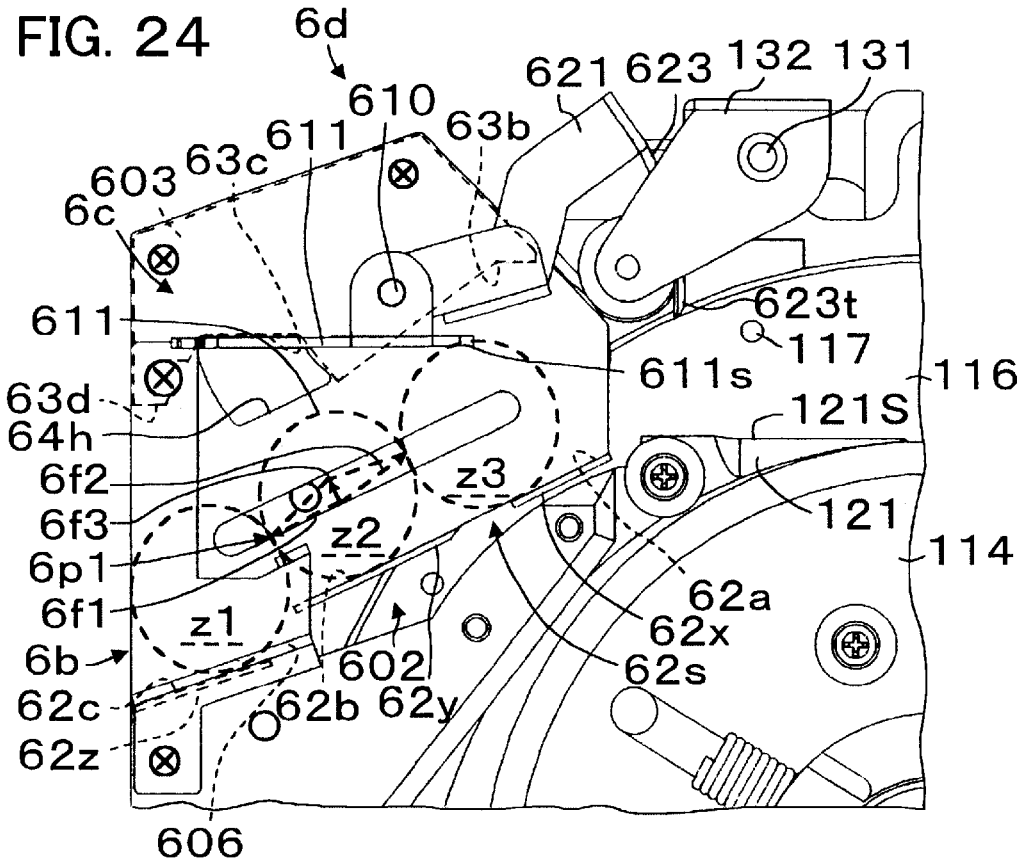
FIG. 24 is a partial rear plan view of the sixth embodiment in normal operation.
Figure 25:
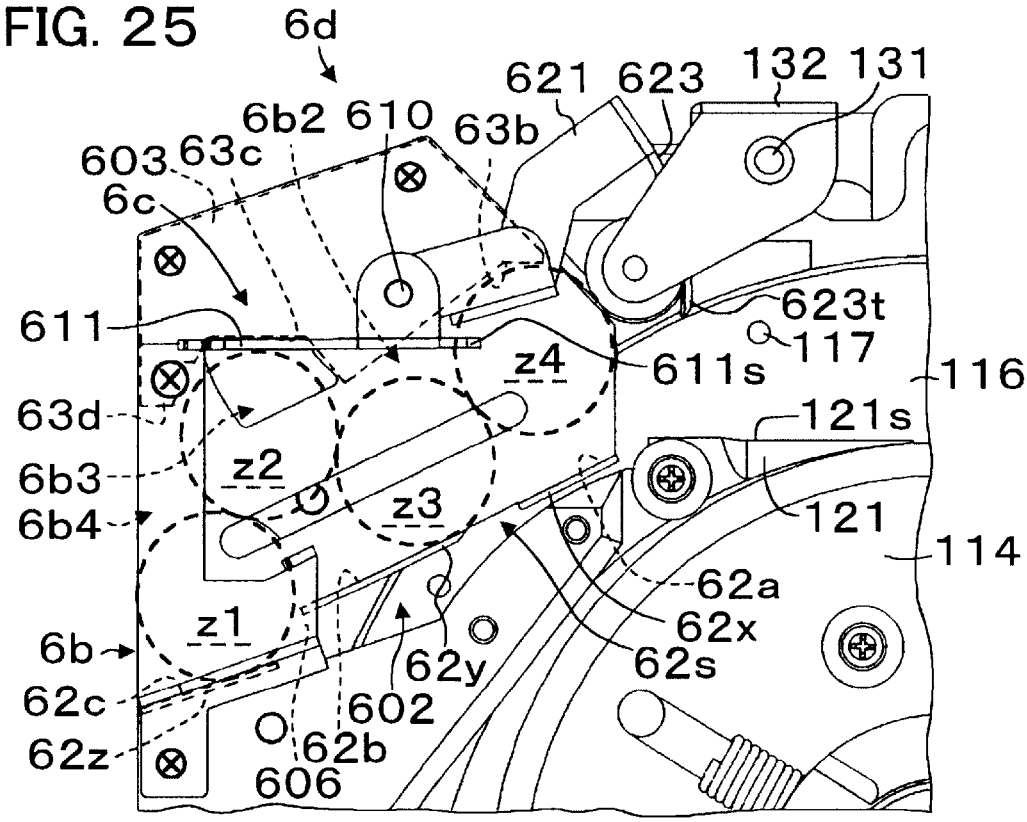
FIG. 25 is a partial rear plan view of the sixth embodiment with coin blockage.

The flexible conjunction 6*e* connects between the detecting lever 611 and the diverter lever 621. In a predetermined position, the detecting lever 611 and the diverter lever 621 can swing as one unit. In another predetermined position, only the diverter lever 621 will swing. The flexible conjunction 6*e* is a spring 612. The middle part of the spring 612 is wound to the fixed shaft 610 and one end of the part is hung to the diverting lever 621, and its other end part is hung to a connecting board 611*c*. The spring 612 is an elastic body, and it can be made of rubber. Therefore, the diverter lever 621 moves in the clockwise direction concerning the detecting lever 611 and is stopped by the stopper 611*s*. As a result, the diverting lever 621 and the detecting lever 611 are straight-like in shape. If the diverter 6*d* moves in the clockwise direction, and the end of the diverting lever 621 connects to an external wall of the rotating disk 114, only the detecting lever 611 can move in the clockwise direction. At this point, the detecting lever 611 and the diverter lever 621 form a jackknife-like shape, as shown in FIGS. 24 and 25. However, the diverter lever 621 continually contacts the rotating disk 114, because it is forced by the force of the flexible conjunction 6*e*.

A coin passage 6*f* is a passage for a coin which is transported by the rotating disk 114. In a situation where the end of the diverter lever 621 contacts the circumference of the rotating disk 114, the push up slant 623*s* slants away from the plane 116. The upper guide 603 is positioned between the cover 604 and the support 625 and fixed with screws, etc. The component has an inverted channel-like shape and is fixed to the hopper base 112. An inspection hole 64*a* is opened along the coin passage 6*b* of the cover 604. The lower end of the cover 604 is not fixed, therefore it is reinforced by a reinforcement piece 627 which is fixed to the hopper base 112.

A spring 628 is connected to a piece 627*s* and the detecting lever 611. Accordingly, the diverter 6*d* moves in a counterclockwise direction and is stopped by the lower end of the elongated hole 64*h*. If the detecting piece is stopped by the lower end of the elongated hole 64*h*, the diverter 6*d* is located in the counterclockwise direction, as shown in FIG. 21. Consequently, the diverter lever 621 is forced by the force of the flexible conjunction 6*e* and is stopped by the stopper 611*s*. The end 623*t* of the diverter 623 will be located outside of the coin passage 6*f*. Therefore, the diverter 623 will contact with coins which are transported by the plane 116.

During a normal operation of the sixth embodiment, the detecting piece 614 will stop at the lower end of the elongated hole 64*h*. The end of the diverter 623 will be located outside of the coin passage 6*f*, as shown in FIG. 21. A coin will move from the rotating disk 114 to the top surface 121*s*, because it is pushed by the pin 117. Next, coins move from the top surface 121*s* to the first guide plane 62*a* also by the pin 117 and will pass below the diverter 623. The coins are moved from the upper surface 121*s* to the first guide 62*a* by the pin 117. The count roller 133 is pushed up by a coin. As a result, the sensor unit detects that the roller 133 has been pushed and outputs a detecting signal, because the lever 132 moves in the clockwise direction. Then the coin rolls at the guide 62*b* and passes through the first passage 6*b*1 and the second passage 6*b*2. Thereafter, the coin rolls along the first guide 62*a*, the guide 62*b*, the detecting guide 62*c* and passes through the entry passage 6*b*1, the driving passage 6*b*2, the third passage 6*b*3 and the exit passage 6*b*4 to be discharged from the coin exit 636.

If a person or an object tries to close the exit 636, as shown in FIGS. 24 and 25, the first coin z1 will be located in the third passage 6b3 and fourth passage 6*b*4. The second coin z2 is guided by the guide 62*b* and locates at guide 62*b*, because it is stopped by the first coin z1. The third coin z3 rolls on the first guide 62*a* and locates at the driving passage 6*b*2, because it is stopped by the second coin z2. The fourth coin z4 moves from the top surface 121*s* to the first guide 62*a* by the pin 117. Accordingly, the third coin z3 is pushed towards the coin exit 636 along the driving passage 6*b*2 and it pushes the second coin z2, as shown in FIG. 24.

The direction of a vector 6*f*1 is parallel to the guide 62*b*. The vector 6*f*1 is a force which is provided from the third coin z3 to the second coin z2. The force direction of the second coin z2 which is pushed by the first coin z1 is on the line which connects between a contact point 6*p*1 and the center of the second coin z2, because there is the gap 606. Consequently, the second coin z2 is forced from the opposition force 6*f*2 of the first coin z1 and the pushing force 6*f*1 of the third coin z3, as shown in FIG. 24. The angle between the opposite force 6*f*1 and the pushing force 6*f*2 is an obtuse angle, and the second coin z2 receives the force 6*f*3 towards the third guide 63*c* from the forces 6*f*1 and 6*f*2. As a result, the second coin z2 is pushed towards the detector 614. The second coin z2 is guided by the wall of the third guide 63*c* and the detector 614 and is placed at the dotted line shown in FIG. 25.

Figure 27:
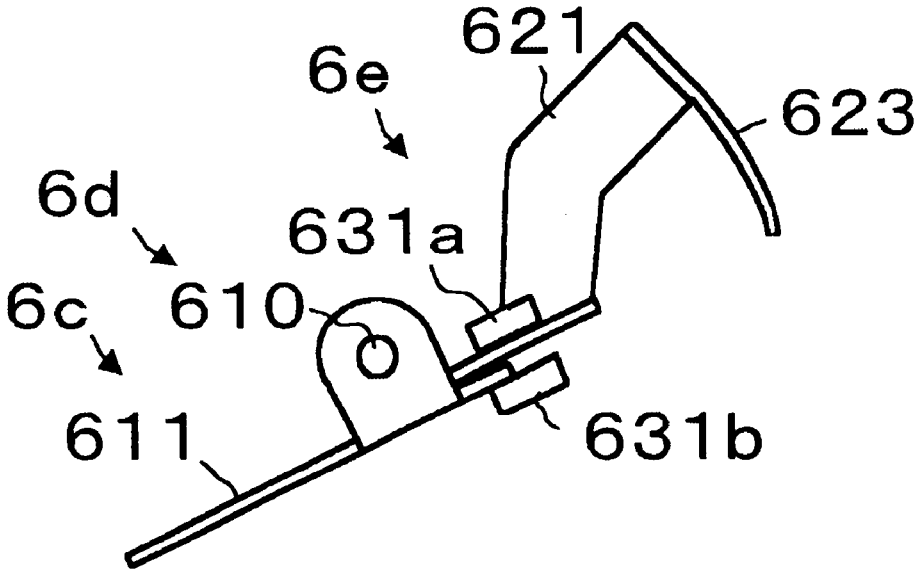
FIG. 27 is an alternative view of a diverter.
Figure 28:
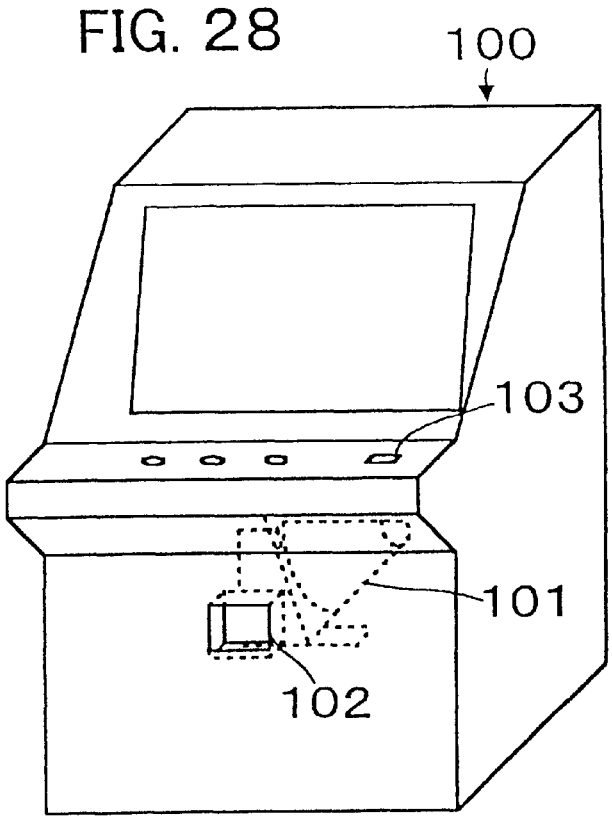
FIG. 28 is a schematic view of a gaming machine.
Figure 29:
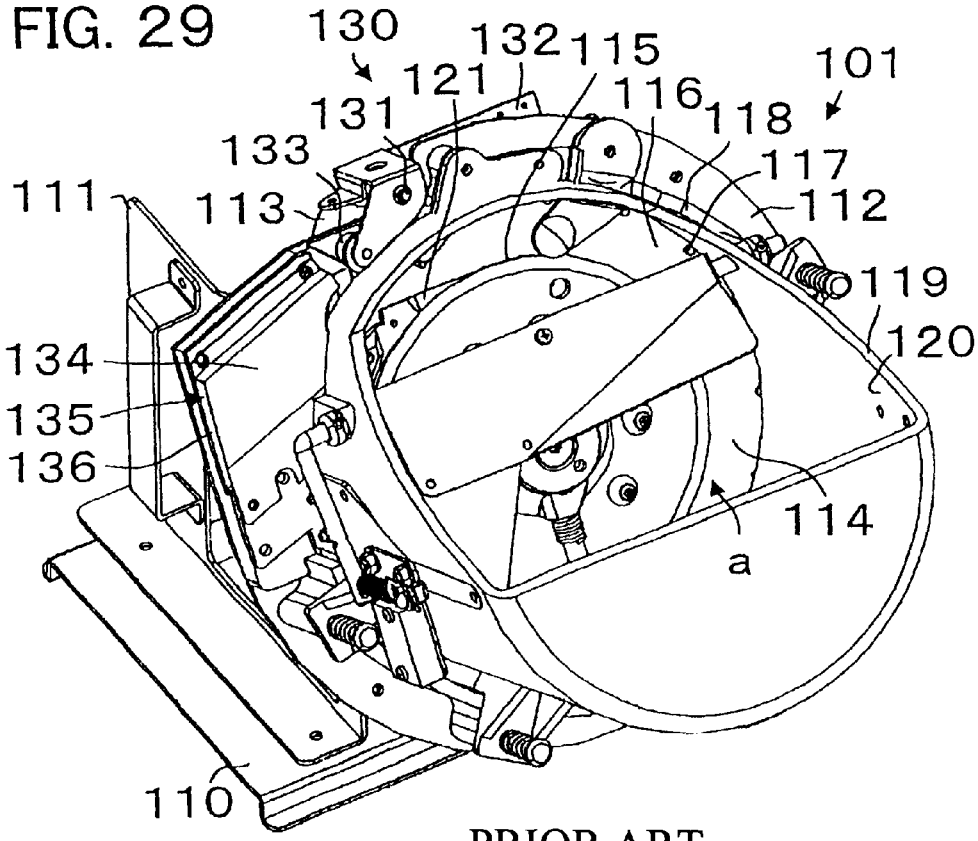
PRIOR ART FIG. 29
FIG. 29 is a perspective view of prior art coin dispenser.

Accordingly, the diverter lever 621 is moved in the clockwise direction at FIG. 24. The end 623*t* of the diverter 623 moves into the coin passage 6*f* and contacts the periphery of the rotating disk 114. Next, the fourth coin z4 is pushed by the pin 117, after the second coin z2 is moved towards the third guide 63*c*. As a result, the fourth coin z3 is moved to the depression 63*b*, because it is stopped by the third coin z3, as shown in FIG. 25. The fourth coin z4 pushes up the count roller 133 and passes through between the third coin z3 and the count roller 133. Next, the count roller 133 returns to a normal position by a spring force. The fourth coin z4 is located at the depression 63*b* which leaves from the first guide 62*a*, because it is supported by the third coin z3 and the count roller 133. Therefore, the detecting lever 611 is moved in the clockwise direction. A spring 612 transforms the diverter lever 621 to continue this position so that the diverter 623 contacts the rotating disk 114. A coin counter 130 counts the moving fourth coin z4. If the pin 117 moves to the side of the fourth coin, it does not come into contact with the fourth coin z4. At this point, the fourth coin z4 does not contact the pin 117. The third coin z3 is slightly pushed up by the pin 114 with the rotation of the rotating disk 114, because the spring 612 is the flexible conjunction 6*e*. In FIG. 27, the detecting lever 611 and the diverter lever 621 are pivoted around the fixed shaft 610. A magnet 631*b* is fixed to the detecting lever 611 and a magnet 631*a* is fixed to the diverter lever 621. The magnet 631*a* and 631*b* attract each other. In this case, the magnet is the flexible conjunction 6*e*.

In another embodiment, the repulsion force between the magnet 631*a* and the magnet 631*b* can be used.

The coin let off device can change to the rotating disk which has a coin pass hole. The detector can detect an area which is made by a coin, because the detector detects a moving coin. The detector can optically detect a coin. The purchaser has the option of one or two alarms, for example, a motor 113, an alarm lamp 77 and an alarm 80. This invention can use other alarm means.

As can be appreciated, when the diverter lever is appropriately positioned, the coins can be returned to the coin hopper. Various embodiments of the present invention can be modified and, in fact, features in one embodiment could be integrated into a hybrid of another embodiment, while still practicing the principles of the present invention. Additionally, a detector unit can also be provided to be optically interacting with a coin that has been elevated to a depression or compartment and various forms of alarms, including a silent alarm that would go to a control center, can be used in the present invention.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. In a coin dispensing mechanism for dispensing stored coins from a storage hopper through a coin passage, the improvement comprising:

a coin passageway having a first compartment to enable a coin to be moved apart from a support surface when a preceding coin is stopped in the passageway; and a detector mounted to operatively determine the location of a coin moved apart from the support surface and into the first compartment to generate a detection signal indicating a blockage of the coin passageway.

2. The invention of claim 1 further including a deflector unit to deflect the entrance of additional coins from the storage hopper when a blockage of the coin passageway occurs.

3. The invention of claim 1 further including a second compartment to receive a second succeeding coin moved apart from the support surface.

4. The invention of claim 3 further including a deflector unit to deflect the entrance of additional coins from the storage hopper when a blockage of the coin passageway occurs.

5. The invention of claim 4 wherein the detector unit includes a movable lever mounted in the coin passageway and contacted by a coin that is moved apart from a support surface.

6. The invention of claim 5 wherein the deflector unit is movably connected to the movable lever and is correspondingly moved to a deflection position when a detection signal is generated by the movement of the movable lever.

7. The invention of claim 4 further including a counter unit for counting the coins translating the passageway, the counter unit is operatively positioned relative to the coin passageway to count each coin that enters the coin passageway, the deflector unit is mounted upstream of the counter unit and when activated prevents coins from contacting the counter unit.

8. In a coin dispensing mechanism for dispensing stored coins from a storage hopper through a coin passage to an exit aperture, wherein a rotating disk selects coins from the storage hopper and delivers individual coins to the coin passage, the improvement comprising:

a coin passageway having a first lower surface for supporting the translation of the coins from the rotary disk and a second upper surface of an undulating configuration complementing to an outer surface of the coin wherein during a normal operation of dispensing coins from the coin dispensing mechanism the dispensed coins only contact the first lower surface and when the coins are blocked from egressing from the exit aperture, one or more coins are nestled against the undulated second upper surface, and a detector unit operatively mounted relative to the second upper surface to detect a coin and indicate a blockage of the coin dispensing mechanism.

9. The invention of claim 8 further including a deflector unit to deflect the entrance of additional coins from the storage hopper when a blockage of the coin passage occurs.

10. The invention of claim 9 further including a deflector unit movably mounted to deflect a coin off of the rotary disk before the coin is introduced into the coin passageway when a blockage of the coin passage occurs.

11. The invention of claim 10 wherein the detector unit includes a movable lever mounted in the coin passageway and contacted by a coin that is moved apart from the first lower surface.

12. The invention of claim 11 wherein the deflector unit is movably connected to the movable lever and is correspondingly moved to a deflection position when a deflection signal is generated by the movement of the movable lever.

13. The invention of claim 10 further including a counter unit for counting the coins translating the passageway, the counter unit is operatively positioned relative to the coin passageway to count each coin that enters the coin passageway, the deflector unit is mounted upstream of the counter unit and when activated prevents coins from contacting the counter unit.

14. A coin dispensing mechanism for dispensing stored coins from a storage hopper comprising:

a dispenser for a coin;

a coin passage, which a coin can pass through;

a detecting guide which constitutes for the coin passage a guide which guides the coins to the position of a detect guide member; and a detector unit which is positioned near the detect guide member to detect a coin blockage.

15. The invention of claim 14 further including a diverter which protrudes upstream of the detecting guide and is connected with the detector.

16. The invention of claim 15 further comprises a control device which controls a drive motor for the dispenser is connected to the detector unit.

* * * * *